US010864746B2

(12) United States Patent
Otome et al.

(10) Patent No.: US 10,864,746 B2
(45) Date of Patent: Dec. 15, 2020

(54) LIQUID CIRCULATING APPARATUS AND LIQUID EJECTING APPARATUS

(71) Applicants: Yukio Otome, Ibaraki (JP); Takahiro Yoshida, Ibaraki (JP); Takayuki Nakai, Kanagawa (JP); Ryuji Yoshida, Kanagawa (JP); Junichi Iwata, Ibaraki (JP)

(72) Inventors: Yukio Otome, Ibaraki (JP); Takahiro Yoshida, Ibaraki (JP); Takayuki Nakai, Kanagawa (JP); Ryuji Yoshida, Kanagawa (JP); Junichi Iwata, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/920,945

(22) Filed: Mar. 14, 2018

(65) Prior Publication Data

US 2018/0272740 A1 Sep. 27, 2018

(30) Foreign Application Priority Data

Mar. 21, 2017 (JP) ..... 2017-054379

(51) Int. Cl.
*B41J 2/195* (2006.01)
*B41J 2/18* (2006.01)

(52) U.S. Cl.
CPC ..... *B41J 2/18* (2013.01); *B41J 2/195* (2013.01)

(58) Field of Classification Search
CPC ..... B41J 2/17509; B41J 2/14233
See application file for complete search history.

(56) References Cited

U.S. PATENT DOCUMENTS

2009/0174735 A1* 7/2009 Yamada ..... B41J 2/175 347/7
2010/0103208 A1* 4/2010 Asami ..... B41J 2/17509 347/7
2016/0059578 A1* 3/2016 Ishikawa ..... B41J 2/14233 347/85
2017/0120602 A1* 5/2017 Nakai ..... B41J 2/175
2017/0297333 A1 10/2017 Kohda et al.

FOREIGN PATENT DOCUMENTS

JP 2014-141032 8/2014
JP 2015-058581 3/2015

* cited by examiner

*Primary Examiner* — Lam S Nguyen
(74) *Attorney, Agent, or Firm* — IPUSA, PLLC

(57) ABSTRACT

A liquid circulating apparatus includes a circulation route configured to circulate liquid through a liquid ejecting head, the circulation route including: a supply-side tank leading to a supply port of the liquid ejecting head; and a discharge-side tank leading to a discharge port of the liquid ejecting head, wherein the liquid is circulated by setting pressure in the supply-side tank higher than pressure in the discharge-side tank, and a sum of the pressure in the supply-side tank and the pressure in the discharge-side tank is set smaller when initial filling for filling the circulation route with the liquid is performed than when the liquid is circulated.

16 Claims, 20 Drawing Sheets

LIQUID CIRCULATING APPARATUS AND LIQUID EJECTING APPARATUS

CROSS-REFERENCE TO RELATED APPLICATION

The present application claims priority under 35 U.S.C. § 119 to Japanese Patent Application No. 2017-054379, filed on Mar. 21, 2017, the entire contents of which are incorporated herein by reference.

BACKGROUND OF THE INVENTION

1. Field of the Invention

The disclosures herein generally relate to a liquid circulating apparatus and a liquid ejecting apparatus.

2. Description of the Related Art

As a liquid ejecting head (hereinafter also simply referred to as "head"), a flow-through type head (circulation-type head) is known that includes a supply flow path leading to individual liquid chambers communicating with nozzles and includes a discharge flow path leading to other individual liquid chambers. The liquid ejecting head also includes a liquid supply port leading to the supply flow path and a liquid discharge port leading to the discharge flow path.

Conventionally, in order to discharge bubbles from the nozzles, it has been known that pressure is applied to liquid from the supply port of the head using a supply-side tank and pressure is also applied to the liquid from a collection port of the head using a discharge-side tank (collection-side tank) (Patent Document 1).

In such a circulation-type head, generally, positive pressure is applied to the supply side and negative pressure is applied to the discharge side such that liquid is circulated through a circulation route including the flow paths in the head.

However, in a case where the circulation route is filled with liquid for the first time at initial filling and a pressure difference is generated such that the liquid is circulated, the discharge side of the circulation route is not filled with the liquid. Therefore, the negative pressure applied to the discharge side is attenuated before being transmitted to a discharge-side common liquid chamber in the head, causing meniscus pressure in the nozzles to become high and the liquid to drip from the nozzles.

RELATED-ART DOCUMENTS

Patent Document

[Patent Document 1] Japanese Unexamined Patent Application Publication No. 2015-058581

SUMMARY OF THE INVENTION

According to at least one embodiment, a liquid circulating apparatus includes a circulation route configured to circulate liquid through a liquid ejecting head, the circulation route including: a supply-side tank leading to a supply port of the liquid ejecting head; and a discharge-side tank leading to a discharge port of the liquid ejecting head, wherein the liquid is circulated by setting pressure in the supply-side tank higher than pressure in the discharge-side tank, and a sum of the pressure in the supply-side tank and the pressure in the discharge-side tank is set smaller when initial filling for filling the circulation route with the liquid is performed than when the liquid is circulated.

Other objects and further features of the present invention will be apparent from the following detailed description when read in conjunction with the accompanying drawings.

DESCRIPTION OF THE PREFERRED EMBODIMENTS

It is a general object of at least one embodiment of the present invention to prevent liquid from dripping at initial filling.

Figure 1:
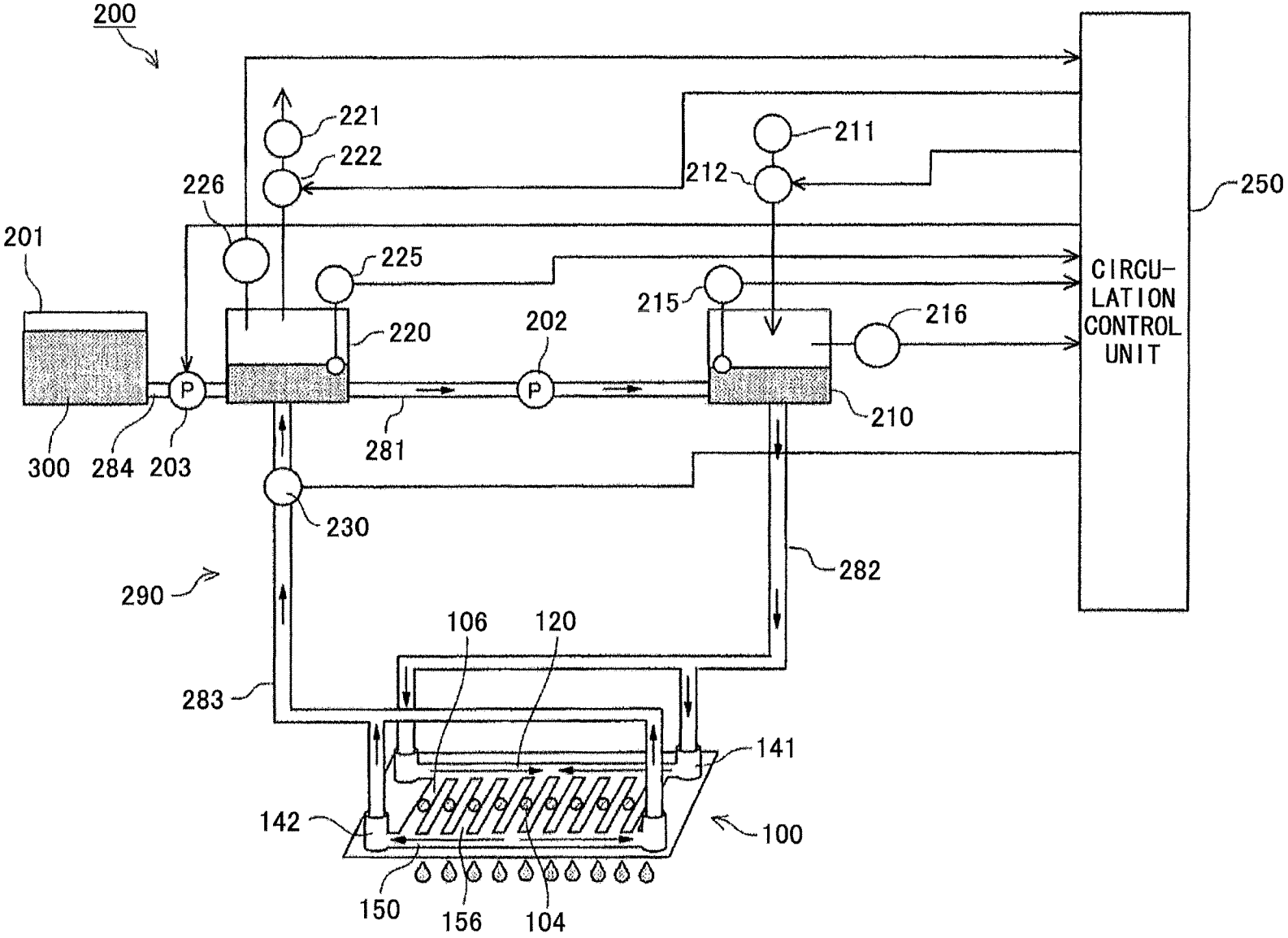
FIG. 1 is a diagram illustrating a liquid circulating apparatus according to a first embodiment of the present invention.

In the following, embodiments of the present invention will be described with reference to the accompanying drawings. A first embodiment of the present invention will be described with reference to FIG. 1. FIG. 1 is a diagram illustrating a liquid circulating apparatus including a liquid ejecting head according to the first embodiment.

A head 100 includes nozzles 104 that eject liquid, supply-side individual liquid chambers 106 that communicate with the nozzles 104, a supply-side common liquid chamber 120 that supplies the liquid to the supply-side individual liquid chambers 106, discharge-side individual liquid chambers 156 that lead from supply-side individual liquid chambers 106, and a discharge-side common liquid chamber 150 that leads from the discharge-side individual liquid chambers 156.

The liquid is supplied to the supply-side common liquid chamber 120 through a supply port 141. The liquid is discharged from the discharge-side common liquid chamber 150 through a discharge port 142.

In the head 100, by applying pressure to liquid in the supply-side individual liquid chambers 106, the liquid is ejected from the nozzles 104. The liquid that is not ejected from the nozzles 104 is discharged from the discharge-side individual liquid chambers 156 to the discharge-side common liquid chamber 150 and re-supplied to the supply-side common liquid chamber 120 through a circulation route provided outside the head.

Further, even when there is no ejection of liquid, the liquid flows from the supply-side common liquid chamber 120 through the supply-side individual liquid chambers 106 and the discharge-side individual liquid chambers 156 into the discharge-side common liquid chamber 150, and is re-supplied to the supply-side common liquid chamber 120 through the circulation route provided outside the head.

A liquid circulating apparatus 200 configured to circulate liquid through the head 100 includes a main tank 201 as a liquid storage that stores liquid 300 ejected from the head 100, a supply-side tank 210, a discharge-side tank (collection-side tank) 220, a first liquid transfer pump 202, and a second liquid transfer pump 203.

The supply-side tank 210 communicates with the discharge-side tank 220 through a liquid passage 281, and communicates with the supply port 141 of the head 100 through a liquid passage 282. The discharge-side tank 220 communicates with the discharge port 142 through a liquid passage 283, and communicates with the main tank 201 through a liquid passage 284.

Namely, by allowing the supply-side tank 210 to communicate with the discharge-side tank 220 through the liquid passage 281, a circulation route 290 is formed such that the liquid is circulated through the liquid passage 282, the flow paths inside the head 100, the liquid passage 283, the discharge-side tank 220, and the liquid passage 281.

Further, the liquid is transferred by the first liquid transfer pump 202 from the discharge-side tank 220 through the liquid passage 281 to the supply-side tank 210. Also, the liquid is transferred by the second liquid transfer pump 203 from the main tank 201 through the liquid passage 284 to the discharge-side tank 220.

A compressor 211 as a compression unit is coupled to the supply-side tank 210 through a regulator 212. The compressor 211 is driven at all times when the apparatus is in operation. The regulator 212 controls pressure in the supply-side tank 210.

The supply-side tank 210 includes, as a remaining amount detecting unit, a supply-side float sensor 215 that detects the remaining amount of liquid as a liquid surface level, and includes, as a pressure detecting unit, a supply-side pressure sensor 216 that detects the pressure in the supply-side tank 210.

A vacuum pump 221 as a pressure reducing unit is coupled to the discharge-side tank 220 through a regulator 222. The vacuum pump 221 is driven at all times when the apparatus is in operation. The regulator 222 controls pressure in the discharge-side tank 220.

The discharge-side tank 220 includes, as a remaining amount detecting unit, a discharge-side float sensor 225 that detects the remaining amount of liquid as a liquid surface level, and includes, as a pressure detecting unit, a discharge-side pressure sensor 226 that detects the pressure in the discharge-side tank 220.

A circulation control unit 250 performs inputting of a signal detected by the supply-side float sensor 215, driving of the first liquid transfer pump 202, and supplying of the liquid 300 from the discharge-side tank 220 to the supply-side tank 210. Also, the circulation control unit 250 performs inputting of a signal detected by the discharge-side float sensor 225, driving of the second liquid transfer pump 203, and refilling of the discharge-side tank 220 with the liquid 300 from the main tank 201.

The circulation control unit 250 inputs a signal detected by the supply-side pressure sensor 216, controls the opening and closing of the regulator 212, and controls the pressure in the supply-side tank 210. The circulation control unit 250 inputs a signal detected by the discharge-side pressure sensor 226, controls the opening and closing of the regulator 222, and controls the pressure in the discharge-side tank 220.

The circulation control unit 250 inputs a signal detected by a flow sensor 230 provided at the liquid passage 283 at the discharge side.

The liquid circulating apparatus 200 having the above-mentioned configuration generates a pressure difference between the pressure in the supply-side tank 210 and the pressure in the discharge-side tank 220 such that the liquid 300 is supplied from the supply-side tank 210 to the supply port 141 of the head 100 and the liquid 300 is discharged (collected) from the discharge port 142 of the head 100 to the discharge-side tank 220.

The liquid 300 supplied to the supply port 141 of the head 100 is supplied to each of the plurality of supply-side individual liquid chambers 106 through the supply-side common liquid chamber 120, and droplets of the liquid 300 are ejected from the nozzles 104 based on image data. The liquid 300 that is not ejected from the nozzles 104 is discharged to the discharge-side common liquid chamber 150 through the discharge-side individual liquid chambers 156, and discharged from the discharge port 142 to the discharge-side tank 220.

To be more specific, when the discharge-side float sensor 225 detects that a liquid surface level in the discharge-side tank 220 becomes lower than a predetermined height, the circulation control unit 250 refills the discharge-side tank 220 with the liquid 300 from the main tank 201 by driving the second liquid transfer pump 203 until the discharge-side float sensor 225 detects that the liquid surface level becomes the predetermined height.

Also, when the supply-side float sensor 215 detects that a liquid surface level in the supply-side tank 210 becomes lower than a predetermined height, the circulation control unit 250 refills the supply-side tank 210 with the liquid 300 from the discharge-side tank 220 by driving the first liquid transfer pump 202 until the supply-side float sensor 215 detects that the liquid surface level becomes the predetermined height.

While the apparatus is turned on, the compressor 211 and the vacuum pump 221 are driven at all times. Also, the supply-side regulator 212 is opened and closed such that the pressure in the supply-side tank 210 detected by the supply-side pressure sensor 216 becomes a predetermined pressure. Further, the discharge-side regulator 222 is opened and closed such that the pressure in the discharge-side tank 220 detected by the discharge-side pressure sensor 226 becomes a predetermined pressure.

In this way, the pressure difference is generated between the supply-side tank 210 and the discharge-side tank 220, allowing the liquid 300 to be circulated from the supply-side tank 210 to the discharge-side tank 220 and to be supplied from the discharge-side tank 220 to the supply-side tank 210. Next, the settings (adjustment) of the pressure in the supply-side tank and the pressure in the discharge-side tank will be described.

Pressure (supply-side pressure) applied to the liquid in the supply-side common liquid chamber 120 is represented by Vin [kPa] and pressure (discharge-side pressure) applied to the liquid in the discharge-side common liquid chamber 150 is represented by Vout [kPa].

Pressure in the supply-side tank 210 (supply-side tank pressure) detected by the supply-side pressure sensor 216 of the supply-side tank 210 is represented by Vtin [kPa] and pressure in the discharge-side tank 220 (discharge-side tank pressure) detected by the discharge-side pressure sensor 226 of the discharge-side tank 220 is represented by Vtout [kPa].

A difference between a liquid surface level in the supply-side tank 210 and a nozzle surface of the head 100 is represented by Htin [m]. A difference between a liquid surface level in the discharge-side tank 220 and the nozzle surface of the head 100 is represented by Htout [m]. When the liquid surface level is higher than the nozzle surface, it is regarded as positive (+) and when the liquid surface level is lower than the nozzle, it is regarded as negative (−).

Fluid resistance in the supply-side individual liquid chambers 106 (supply-side fluid resistance) is represented by Rin [Pa·s/m$^3$] and fluid resistance in the discharge-side individual liquid chambers 156 (discharge-side fluid resistance) is represented by Rout [Pa·s/m$^3$].

Fluid resistance between the supply-side common liquid chamber 120 of the head 100 and the supply-side tank 210 is represented by Rtin [Pa·s/m$^3$] and fluid resistance between the discharge-side common liquid chamber 150 of the head 100 and the discharge-side tank 220 is represented by Rtout [Pa·s/m$^3$].

Pressure on the meniscus formed in the nozzles 104 of the head 100 (meniscus pressure) is represented by Vm. The meniscus pressure Vm can be calculated by the following formulas (1) to (3).

[Formula 1]

$$Vm=(Vin\times Rout+Vout\times Rin)/(Rin+Rout) \quad (1)$$

[Formula 2]

$$Vm=[(Vout+Vin\times(Rout/Rin)]/(1+Rout/Rin) \quad (2)$$

[Formula 3]

$$Vm=(Vout/Vin+Rout/Rin)/[(1+Rout/Rin)/Vin] \quad (3)$$

Also, the supply-side pressure Vin can be calculated by the following formula (4).

[Formula 4]

$$Vin=(Vtin+Htin\times 9.81)-[(Vtin+Htin\times 9.81)-(Vtout+Htout\times 9.81)]/(Rtin+Rin+Rout+Rtout)\times Rtin \quad (4)$$

Also, the discharge-side pressure Vout can be calculated by the following formula (5).

[Formula 5]

$$Vout=(Vtout+Htout\times 9.81)+[(Vtin+Htin\times 9.81)-(Vtout+Htout\times 9.81)]/(Rtin+Rin+Rout+Rtout)\times Rtout \quad (5)$$

When liquid is circulated, including when the liquid is ejected from the nozzles 104 based on image data, the pressure Vtin in the supply-side tank 210 and the pressure Vtout in the discharge-side tank 220 are adjusted such that the meniscus pressure Vm in the nozzles becomes within a range of 0 to −2 [kPa].

Also, when initial filling for filling the head 100 with the liquid for the first time is performed, the pressure Vtin in the supply-side tank 210 and the pressure Vtout in the discharge-side tank 220 are adjusted such that the meniscus pressure Vm in the nozzles becomes within a range of −2 to −6 [kPa] until at least the inside of the circulation route 290 including the head 100 is filled with the liquid.

The sum of the pressure Vtin in the supply-side tank 210 and the pressure Vtout in the discharge-side tank 220 (Vtin+Vtout) is set smaller when the initial filling is performed than when the liquid is circulated. As a result, the meniscus pressure Vm becomes lower when the initial filling is performed than when the liquid is circulated.

As described above, the meniscus pressure Vm is made lower when the initial filling is performed than when the liquid is circulated. Accordingly, even in a case where negative pressure generated in the discharge-side tank 220 is attenuated before being transmitted to the discharge-side common liquid chamber 150 of the head 100 because the circulation route 290 is not yet filled with the liquid at the time of the initial filling, it is possible to prevent the meniscus pressure Vm from becoming excessively high and prevent the liquid from dripping.

By using, for example, either of the following methods, the sum of the pressure Vtin in the supply-side tank 210 and the pressure Vtout in the discharge-side tank 220 (Vtin+Vtout) can be made smaller when the initial filling is performed than when the liquid is circulated.

(1) The pressure Vtin in the supply-side tank 210 is made lower when the initial filling is performed than when the liquid is circulated. Accordingly, the liquid flow rate decreases compared to when the liquid is circulated. Therefore, the liquid transfer capacity of the first liquid transfer pump is not required to be increased.

(2) The pressure Vtout in the discharge-side tank 220 is made lower (the negative pressure increases) when the initial filling is performed than when the liquid is circulated. Accordingly, a difference between the pressure Vtin in the supply-side tank 210 and the pressure Vtout in the discharge-side tank 220 becomes large and the liquid flow rate increases, allowing a filling time to be shortened.

(3) Both the pressure Vtin in the supply-side tank 210 and the pressure Vtout in the discharge-side tank 220 are made lower when the initial filling is performed than when the liquid is circulated. Accordingly, the liquid transfer capacity of the first pump and the filling flow rate can match.

These methods will be described below in detail by giving an example. In the example below, liquid is written as ink and a piezoelectric actuator is used as an actuator that pressurizes individual liquid chambers.

Figure 2:
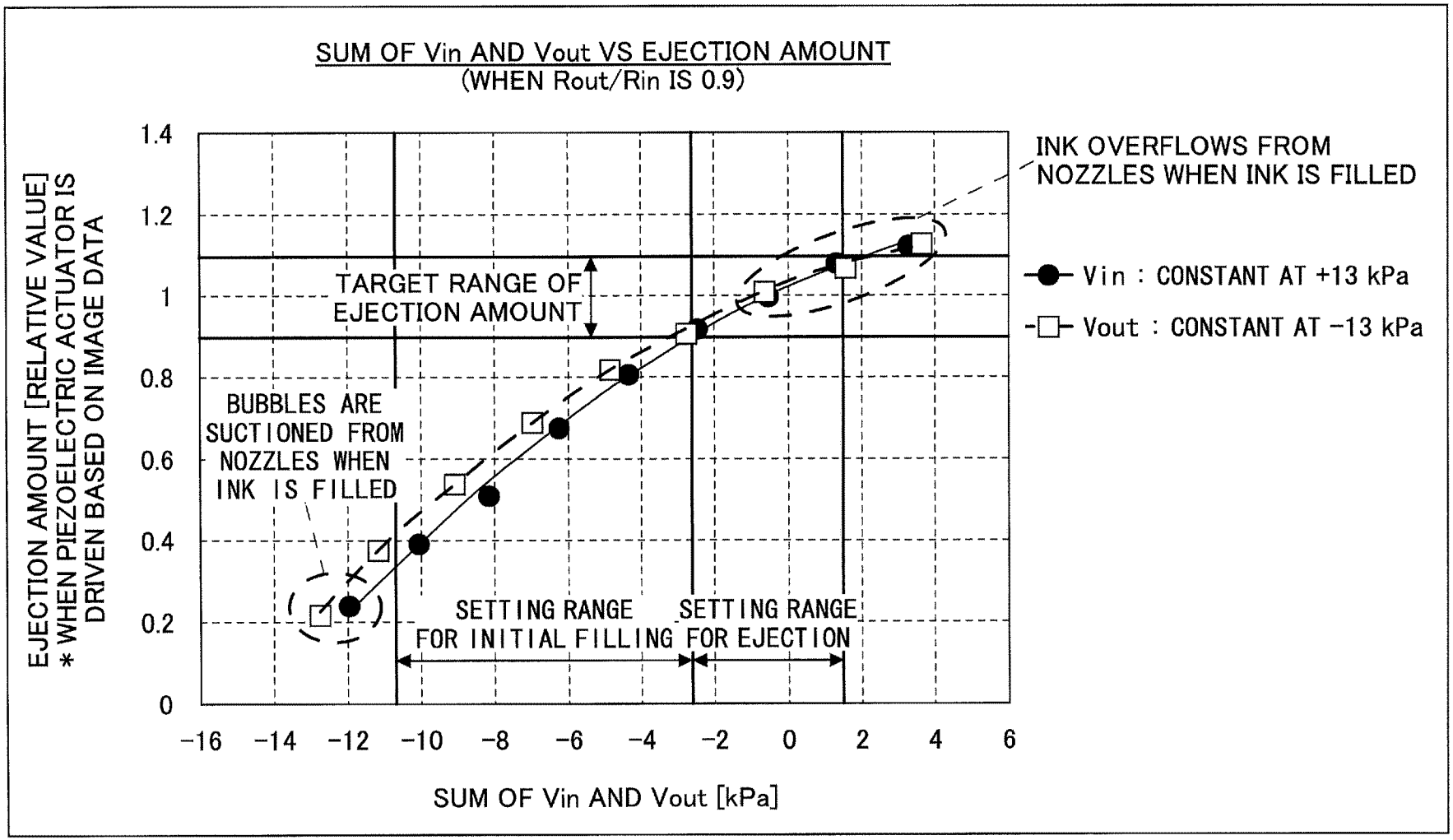
FIG. 2 is a graph illustrating effects of the liquid circulating apparatus.

First, by changing the sum of the supply-side pressure Vin and the discharge-side pressure Vout, an ejection amount of ink ejected from the nozzles 104 based on image data, and occurrences of an overflow of the ink (liquid dripping) from the nozzles 104 and suction of bubbles when the head 100 (containing no ink) is initially filled with the ink (initial filling) are investigated. FIG. 2 illustrates results of the investigation.

In FIG. 2, when the sum of the supply-side pressure Vin and the discharge-side pressure Vout is −2.7 to 1.4 kPa, a target range of the ejection amount is met. Also, when the sum of the supply-side pressure Vin and the discharge-side pressure Vout is from −2.7 to −10.7 kPa, ink does not overflow (no liquid dripping) from the nozzles 104 and bubbles are not suctioned from the nozzles 104 when the head 100 (containing no ink) is initially filled with the ink (initial filling).

Figure 3:
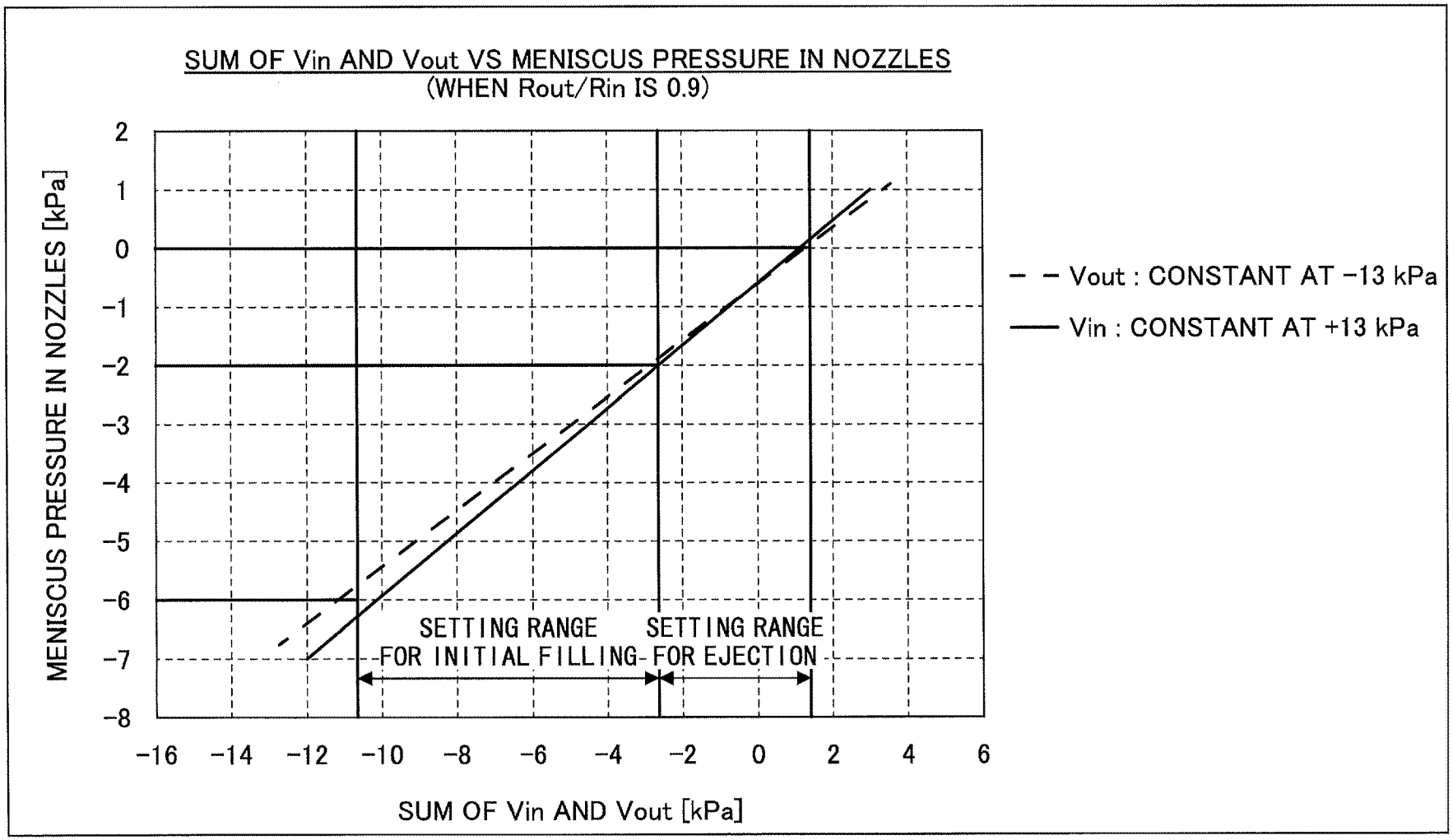
FIG. 3 is a graph also illustrating effects of the liquid circulating apparatus.

In the above-described investigation, pressure on the meniscus in the nozzles 104 is calculated. FIG. 3 illustrates results. The meniscus pressure Vm is calculated using the above-described formula (2).

As seen from the results, by setting the meniscus pressure Vm within the range of 0 to −2 kPa when the ink is ejected based on the image data (the ink is circulated), and by setting the meniscus pressure Vm within the range of −2 to −6 kPa when the initial filling is performed, it is possible to fill the ink without the ink overflowing from the nozzles or bubbles being suctioned from the nozzles. Also, after the ink is filled, favorable printing quality can be achieved.

In this investigation, the ratio of the fluid resistance Rout to the fluid resistance Rin (Rout/Rin) is 0.9. When the ratio of the fluid resistance Rout to the fluid resistance Rin (Rout/Rin) is 0.7 or 0.8, a setting range of the sum of the supply-side pressure Vin and the discharge-side pressure Vout that falls within the target range of the ejection amount and a setting range of the sum of the supply-side pressure Vin and the discharge-side pressure Vout that prevents ink from overflowing from nozzles and bubbles from being suctioned from the nozzles differ from the respective setting ranges when the ratio of the fluid resistance Rout to the fluid resistance Rin (Rout/Rin) is 0.9; however, the values of the meniscus pressure Vm in the nozzles with respect to setting range are the same as for the ratio of the fluid resistance Rout to the fluid resistance Rin (Rout/Rin) being 0.9.

Figure 4:
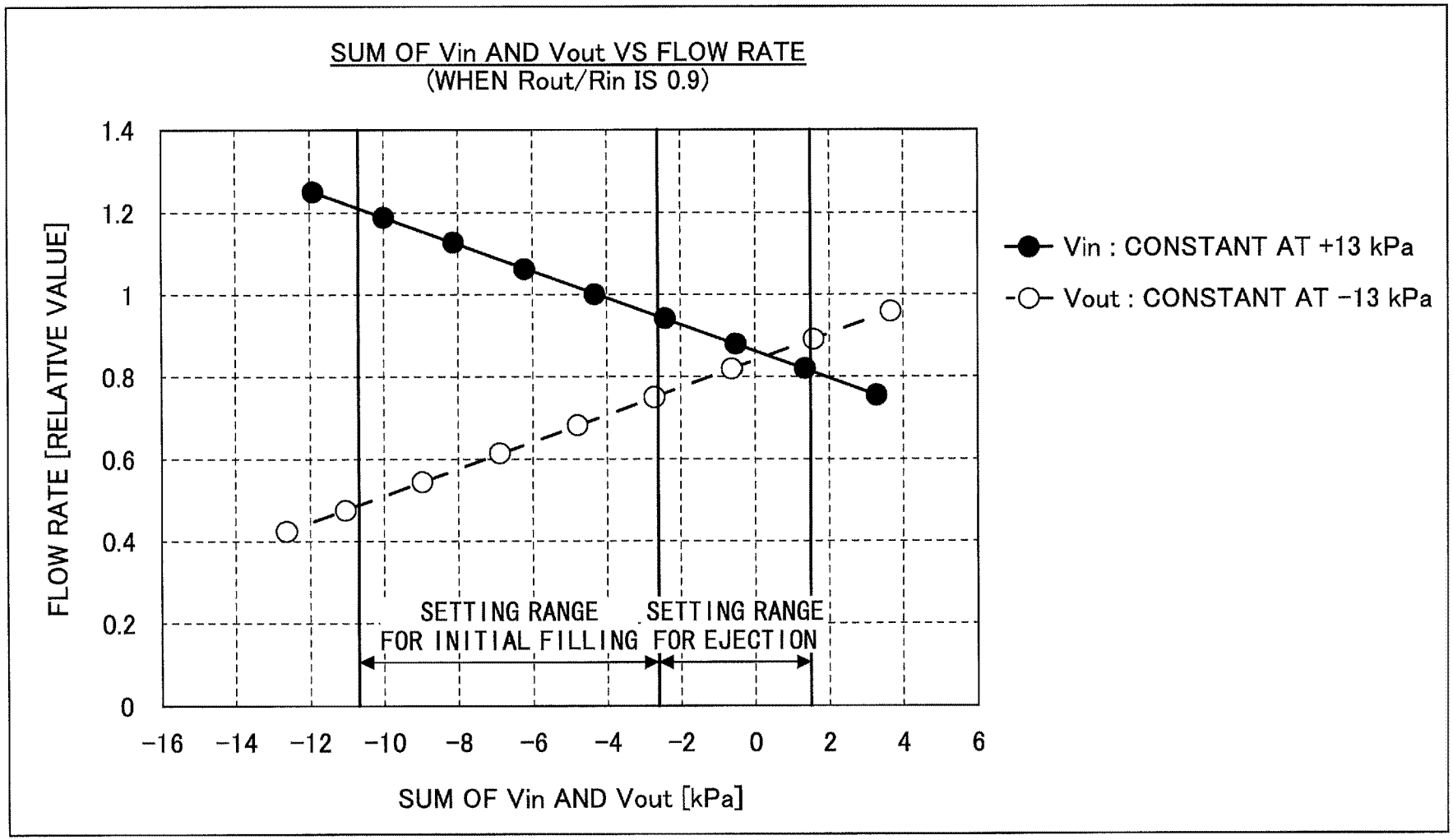
FIG. 4 is a graph also illustrating effects of the liquid circulating apparatus.

Next, a filling time (time from ink starting to be supplied to the head containing no ink until all the nozzles becoming ready to eject the ink) is investigated when the ratio of the fluid resistance Rout to the fluid resistance Rin (Rout/Rin) is 0.9. When the discharge-side pressure Vout is constant at +13 kPa, the filling time is 1 to 5 minutes. When the discharge-side pressure Vout is constant at −13 kPa, the filling time is 6 to 10 minutes. FIG. 4 illustrates results of flow rates measured under the above-described conditions.

At the initial filling, the flow rate is larger when the supply-side pressure is constant at +13 kPa than when the discharge-side pressure Vout is constant at −13 kPa. The filling time becomes shorter as the flow rate becomes larger. Therefore, the filling time is shorter when the supply-side pressure is constant at +13 kPa than when the discharge-side pressure Vout is constant at −13 kPa.

Also, when the supply-side pressure Vin is constant at +13 kPa, the flow rate is larger when the sum of Vin and Vout falls within the setting range for the initial filling than when the sum of Vin and Vout falls within the setting range for the ejection. When the discharge-side pressure Vout is constant at −13 kPa, the flow rate is smaller when the sum of Vin and Vout falls within the setting range for the initial filling than when the sum of Vin and Vout falls within the setting range for the ejection.

Accordingly, when the supply-side pressure Vin is constant, the filling time can be shortened. However, because the flow rate is larger when the sum of Vin and Vout falls within the setting range for the initial filling than when the sum of Vin and Vout falls within the setting range for the ejection, the first liquid transfer pump 202 is required to have a large transfer capability that enables a high flow rate at the initial filling.

Figure 5:
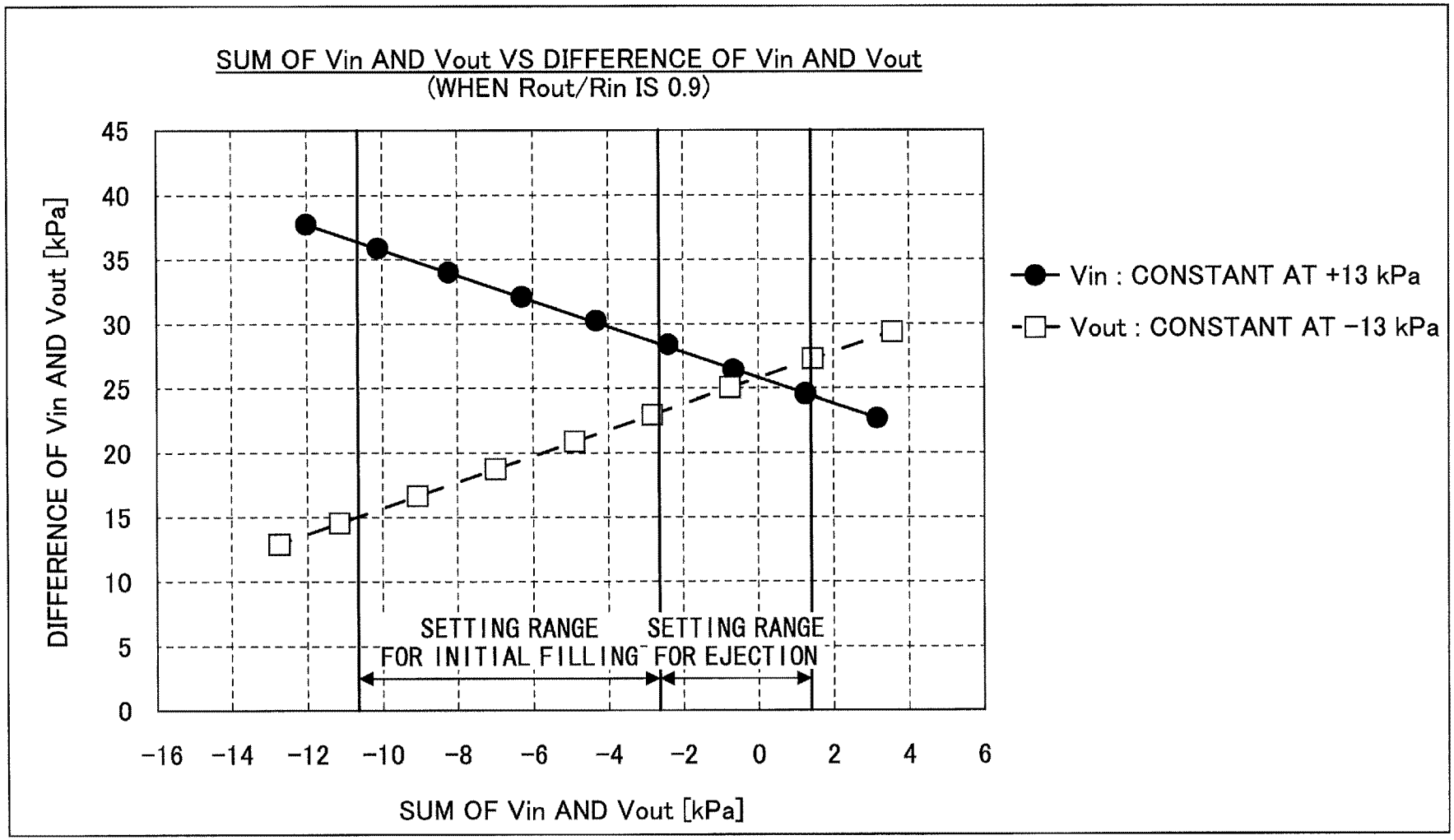
FIG. 5 is a graph also illustrating effects of the liquid circulating apparatus.

Next, FIG. 5 illustrates a relationship between the sum and the difference of the supply-side pressure Vin and the discharge-side pressure Vout for cases where the supply-side pressure Vin is constant and the discharge-side pressure Vout is constant. Also, FIG. 6 illustrates a relationship between the difference of the supply-side pressure Vin and the discharge-side pressure Vout and a flow rate for cases where the supply-side pressure Vin is constant and the discharge-side pressure Vout is constant.

Figure 6:
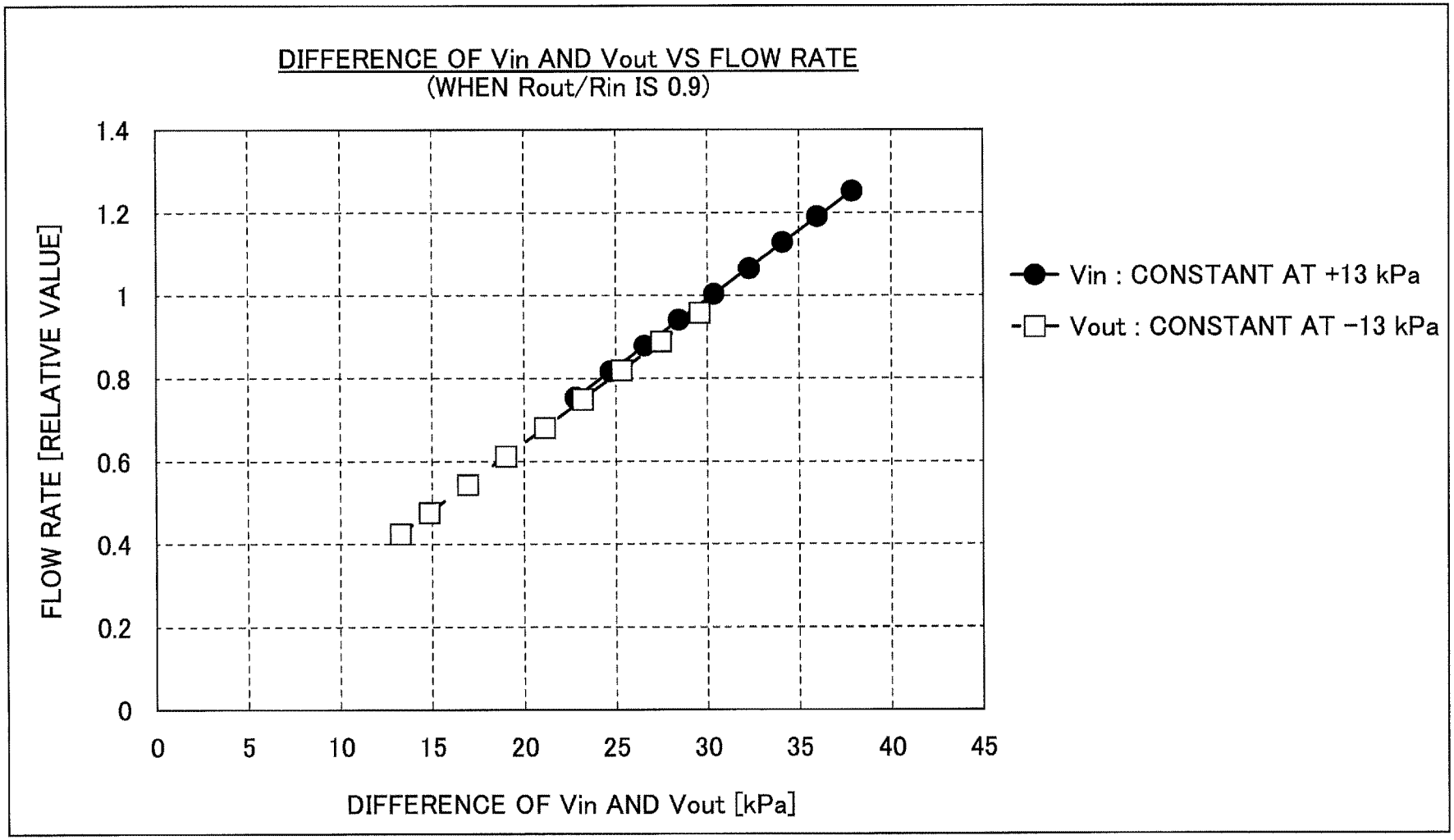
FIG. 6 is a graph also illustrating effects of the liquid circulating apparatus.

As seen from FIG. 6, the relationship between the difference of the supply-side pressure Vin and the discharge-side pressure Vout versus the flow rate is the same for both cases of the supply-side pressure Vin being constant and the discharge-side pressure Vout being constant. As seen from FIG. 5, the difference between the supply-side pressure Vin and the discharge-side pressure Vout is larger when the supply-side pressure Vin is constant than when the discharge-side pressure Vout is constant. Therefore, the flow rate is larger when the supply-side pressure Vin is constant than when the discharge-side pressure Vout is constant.

Figure 7:
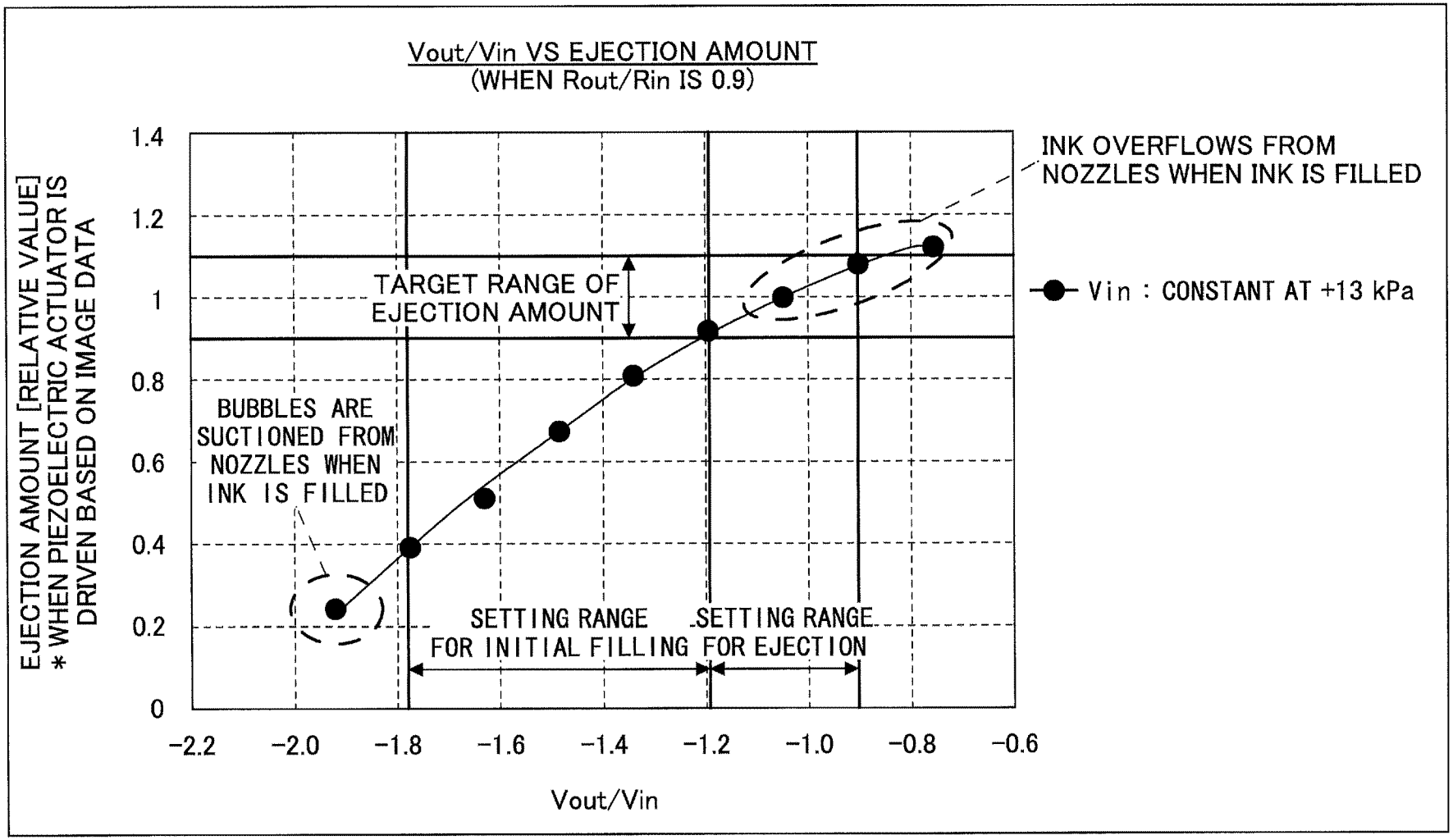
FIG. 7 is a graph also illustrating effects of the liquid circulating apparatus.
Figure 8:
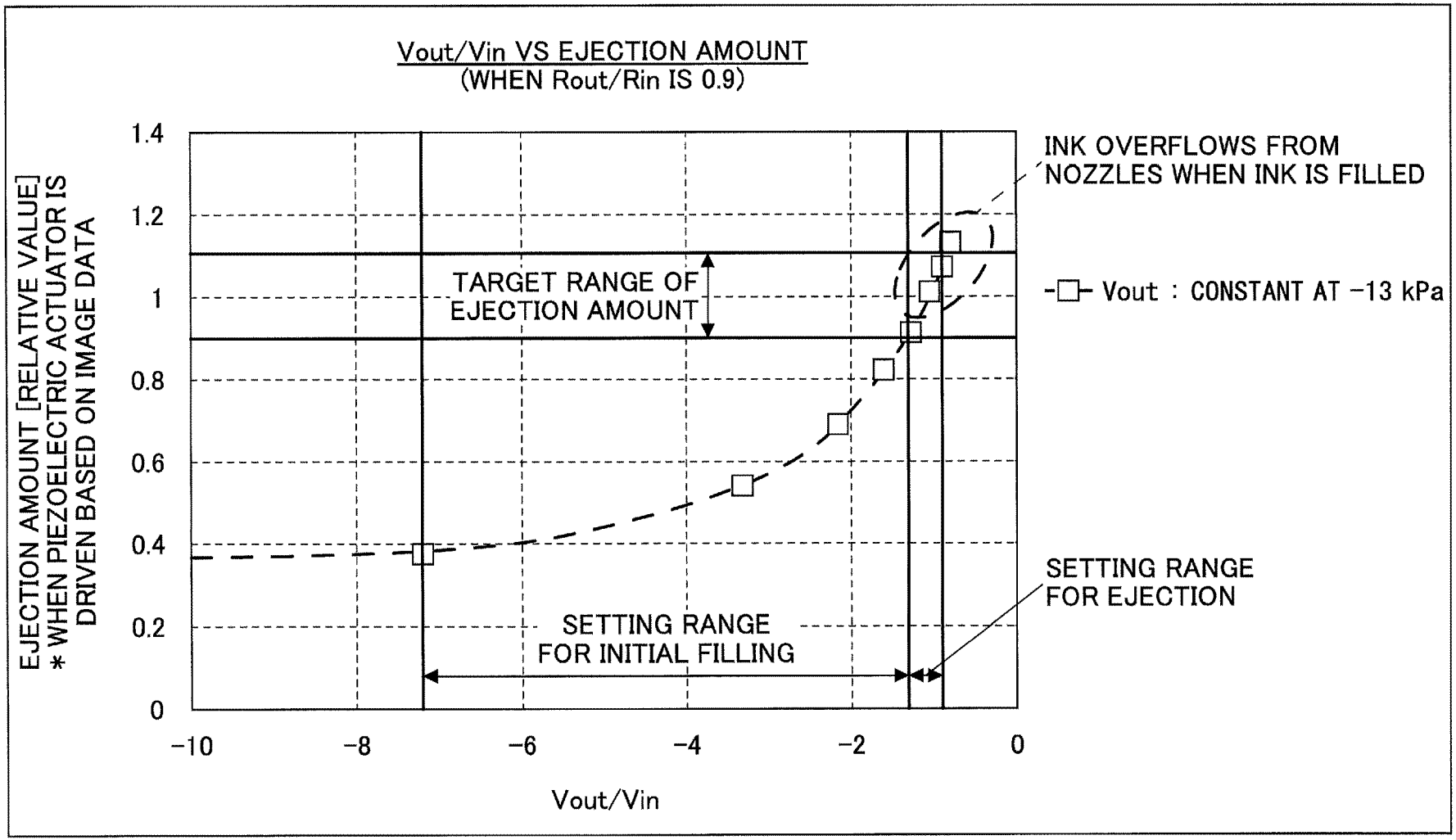
FIG. 8 is a graph also illustrating effects of the liquid circulating apparatus.

Further, by changing the ratio of the discharge-side pressure Vout to the supply-side pressure Vin, an ejection amount of ink ejected from the nozzles based on image data and occurrences of an overflow of the ink from the nozzles and suction of bubbles are investigated. FIG. 7 and FIG. 8 illustrate results of the investigation.

In FIG. 7, when the ratio of the discharge-side pressure Vout to the supply-side pressure Vin (Vout/Vin) ranges from −0.9 to −1.2 kPa, the target range of the ejection amount is met. Also, when the ratio of the discharge-side pressure Vout to the supply-side pressure Vin (Vout/Vin) ranges from −1.2 to −1.8 kPa, the ink does not overflow from the nozzles 104 and bubbles are not suctioned from the nozzles 104 when the initial filling is performed.

In FIG. 8, when the ratio of the discharge-side pressure Vout to the supply-side pressure Vin (Vout/Vin) ranges from −0.9 to −1.3 kPa, the target range of the ejection amount is met. Also, when the ratio of the discharge-side pressure Vout to the supply-side pressure Vin (Vout/Vin) ranges from −1.3 to −7.2 kPa, the ink does not overflow from the nozzles 104 and bubbles are not suctioned from the nozzles 104 when the initial filling is performed.

Figure 9:
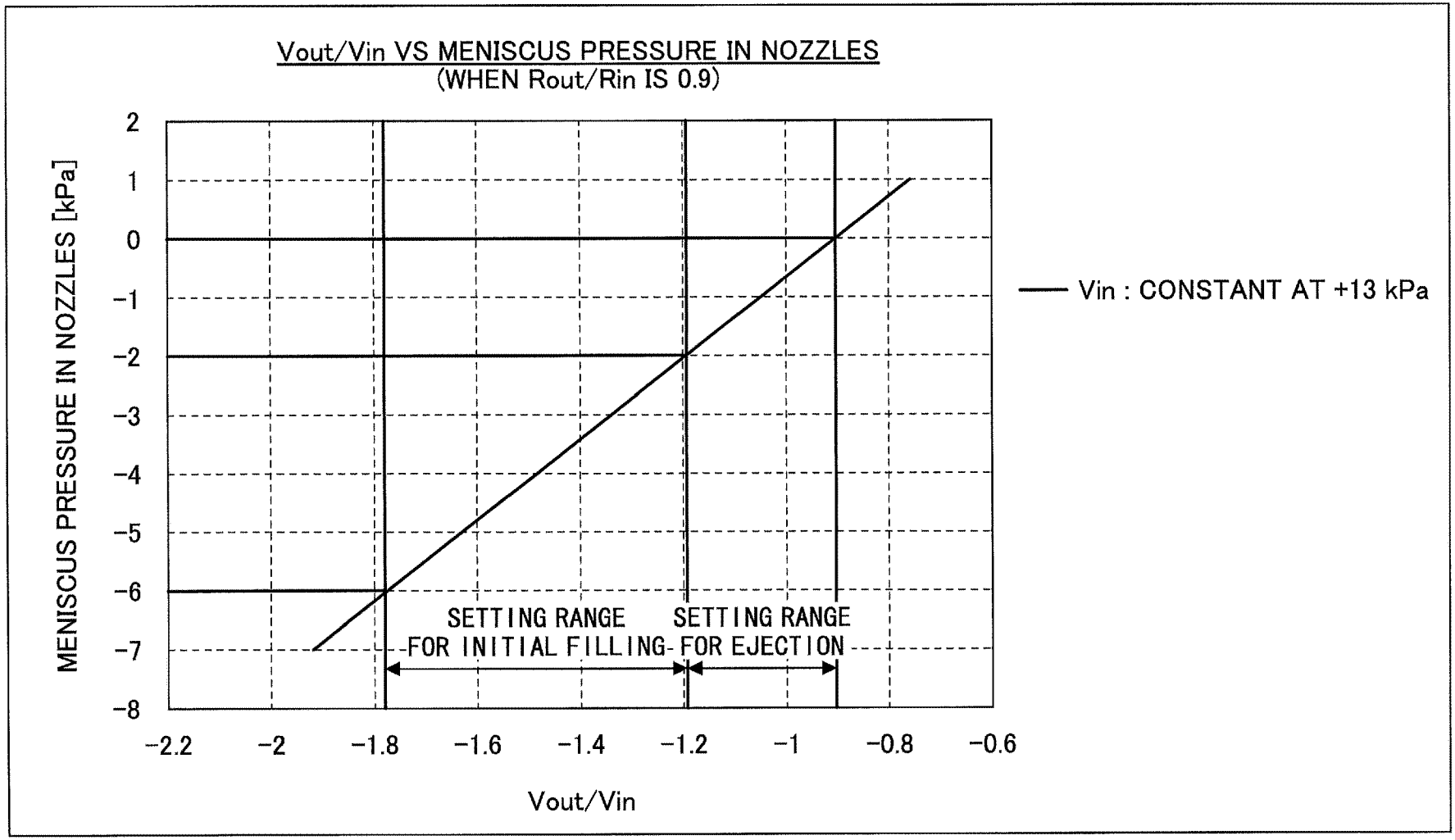
FIG. 9 is a graph also illustrating effects of the liquid circulating apparatus.
Figure 10:
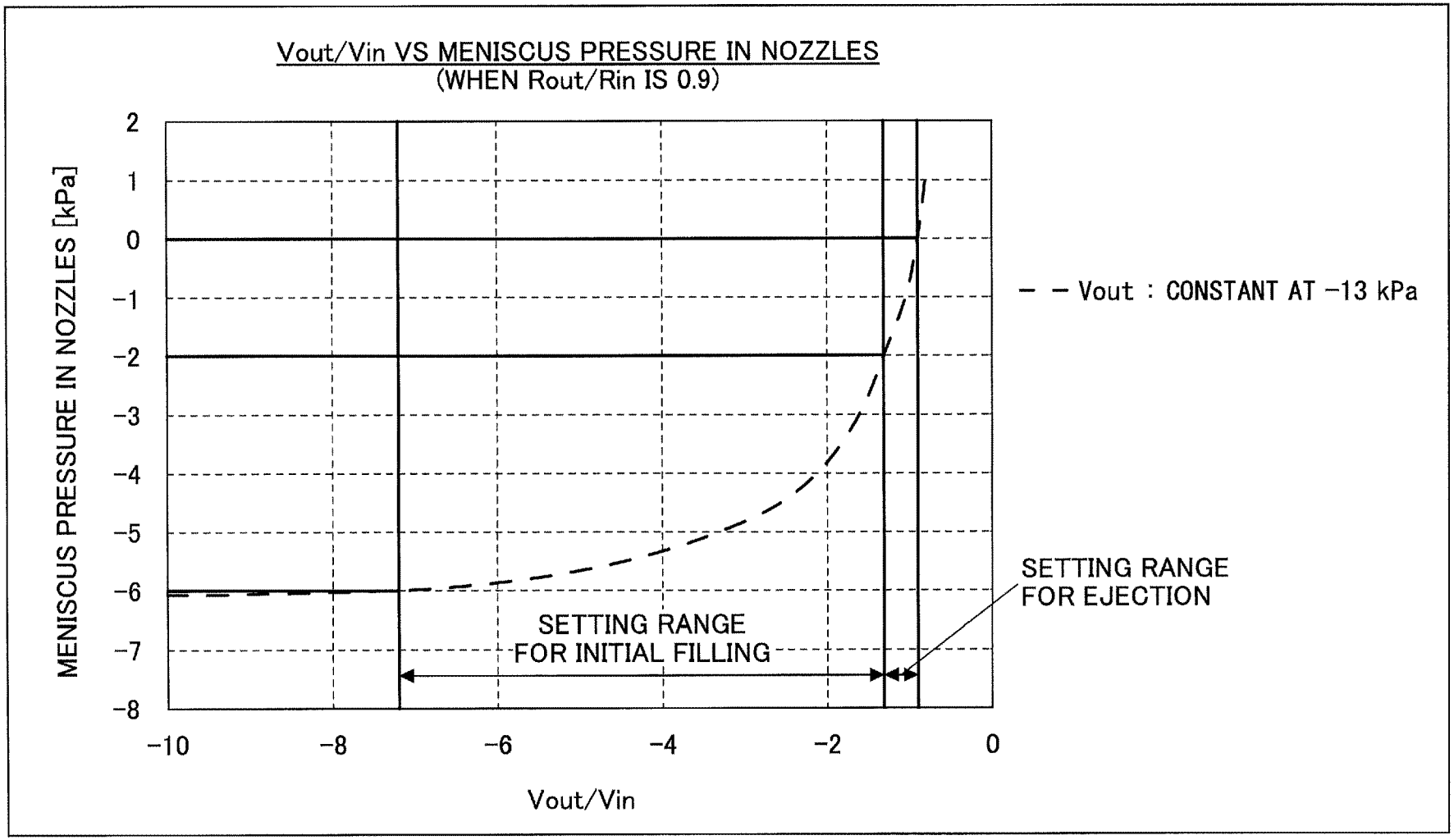
FIG. 10 is a graph also illustrating effects of the liquid circulating apparatus.

In this investigation, FIG. 9 and FIG. 10 illustrate the meniscus pressure Vm calculated using the formula (2).

As seen from FIG. 9 and FIG. 10, by setting the meniscus pressure Vm in the nozzles 104 within the range of 0 to −2 kPa when the ink is ejected from the nozzles 104 based on the image data (when the ink is circulated), and by setting the meniscus pressure Vm within the range of −2 to −6 kPa when the initial filling is performed, it is possible to fill the ink without the ink overflowing from the nozzles or bubbles being suctioned from the nozzles. Also, after the ink is filled, favorable printing quality can be achieved.

In this investigation, the ratio of the fluid resistance Rout to the fluid resistance Rin (Rout/Rin) is 0.9. When the ratio of the fluid resistance Rout to the fluid resistance Rin (Rout/Rin) is 0.7 or 0.8, a setting range of the ratio of the discharge-side pressure Vout to the supply-side pressure Vin (Vout/Vin) that falls within the target range of the ejection amount and a setting range of the Vout/Vin that prevents ink from overflowing from nozzles and bubbles from being suctioned from the nozzles differ from the respective setting ranges when the ratio of the fluid resistance Rout to the fluid resistance Rin (Rout/Rin) is 0.9; however, the values of the meniscus pressure Vm in the nozzles with respect to setting range are the same as for the ratio of the fluid resistance Rout to the fluid resistance Rin (Rout/Rin) being 0.9.

The filling time is investigated when the ratio of the fluid resistance Rout to the fluid resistance Rin (Rout/Rin) is 0.9. When the supply-side pressure Vin is constant at +13 kPa, the filling time is 1 to 5 minutes. When the discharge-side pressure Vout is constant at −13 kPa, the filling time is 6 to 10 minutes.

Figure 11:
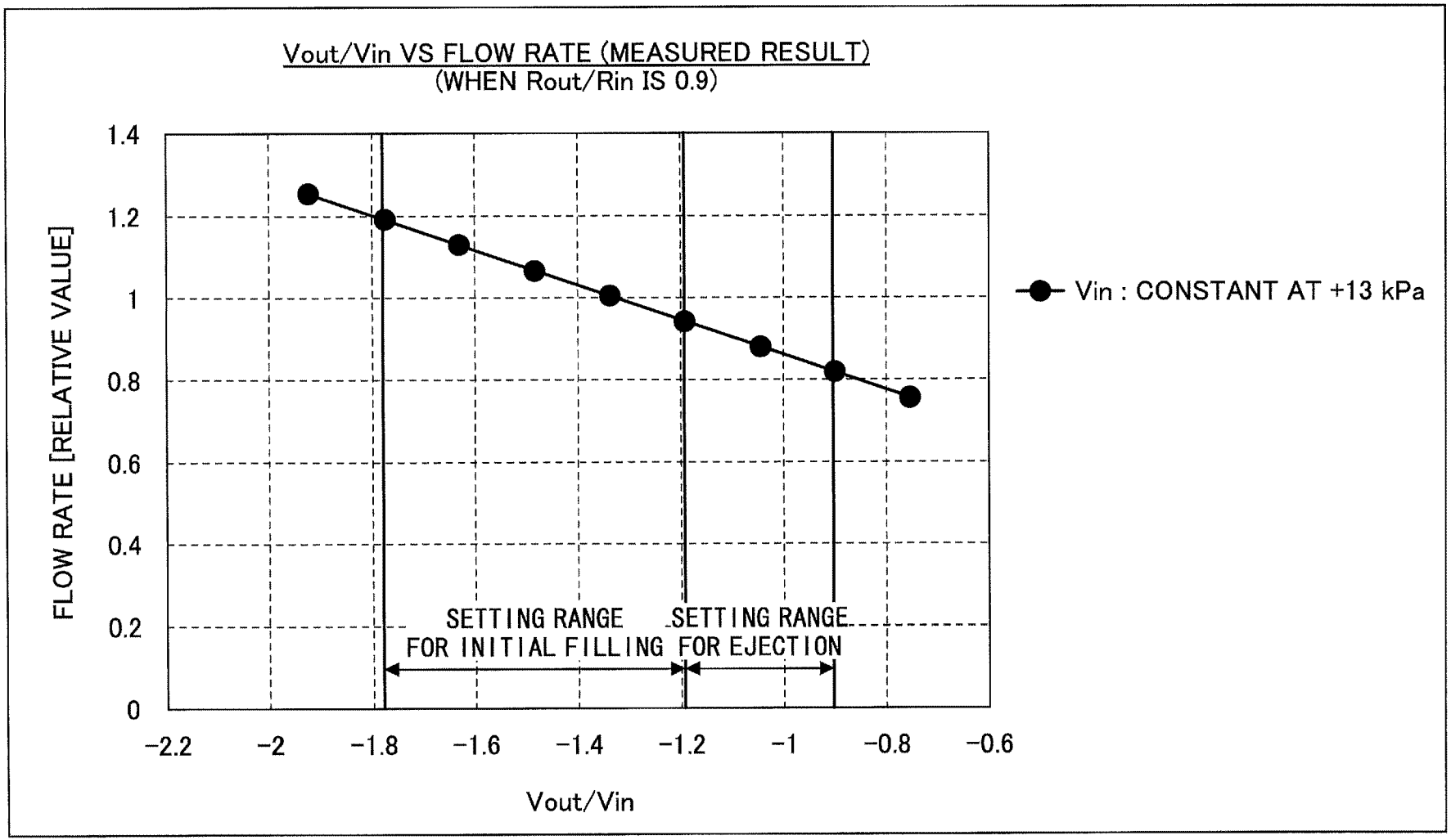
FIG. 11 is a graph also illustrating effects of the liquid circulating apparatus.
Figure 12:
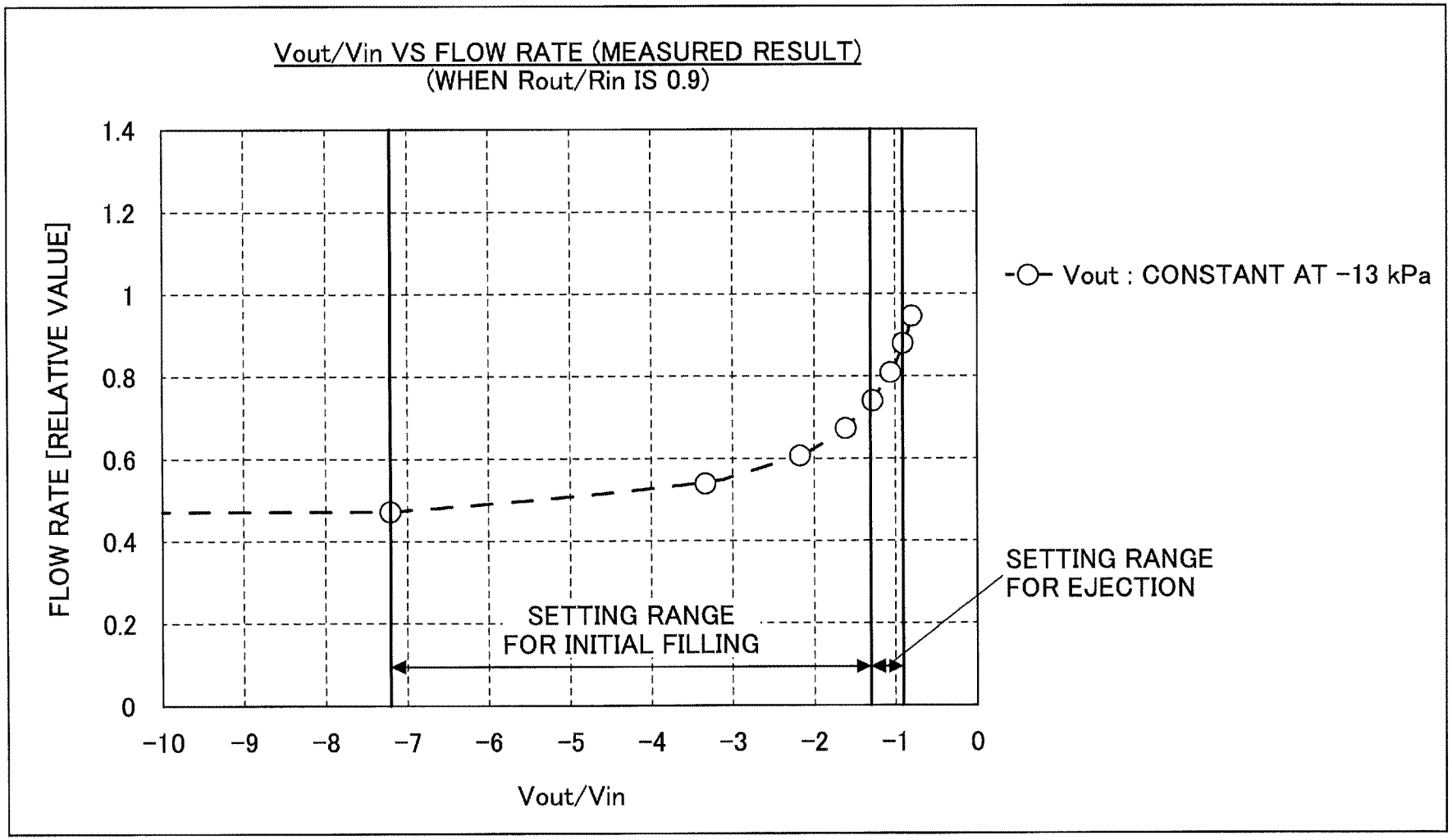
FIG. 12 is a graph also illustrating effects of the liquid circulating apparatus.

FIG. 11 and FIG. 12 illustrate results of flow rates measured under the above-described conditions. At the initial filling, the flow rate is larger when the supply-side pressure Vin is constant at +13 kPa than when the discharge-side pressure Vout is constant at −13 kPa. The filling time becomes shorter as the flow rate becomes larger. Therefore, the reason why the filling time is shorter when the supply-side pressure is constant at +13 kPa than when the discharge-side pressure Vout is constant at −13 kPa is because the flow rate is larger.

Further, when supply-side pressure Vin is constant at +13 kPa, the flow rate is larger when the ratio of Vout to Vin falls within the setting range for the initial filling than when the ratio of Vout to Vin falls within the setting range for the ejection. When the discharge-side pressure Vout is constant at −13 kPa, the flow rate is smaller when the ratio of Vout to Vin falls within the setting range for the initial filling than when the ratio of Vout to Vin falls within the setting range for the ejection.

Accordingly, when the supply-side pressure Vin is constant, the filling time can be shortened. However, as the flow rate is larger when the ratio of Vout to Vin falls within the setting range for the initial filling than when the ratio of Vout to Vin falls within the setting range for the ejection, the first liquid transfer pump 202 is required to have a large transfer capability that enables a high flow rate at the initial filling.

Figure 13:
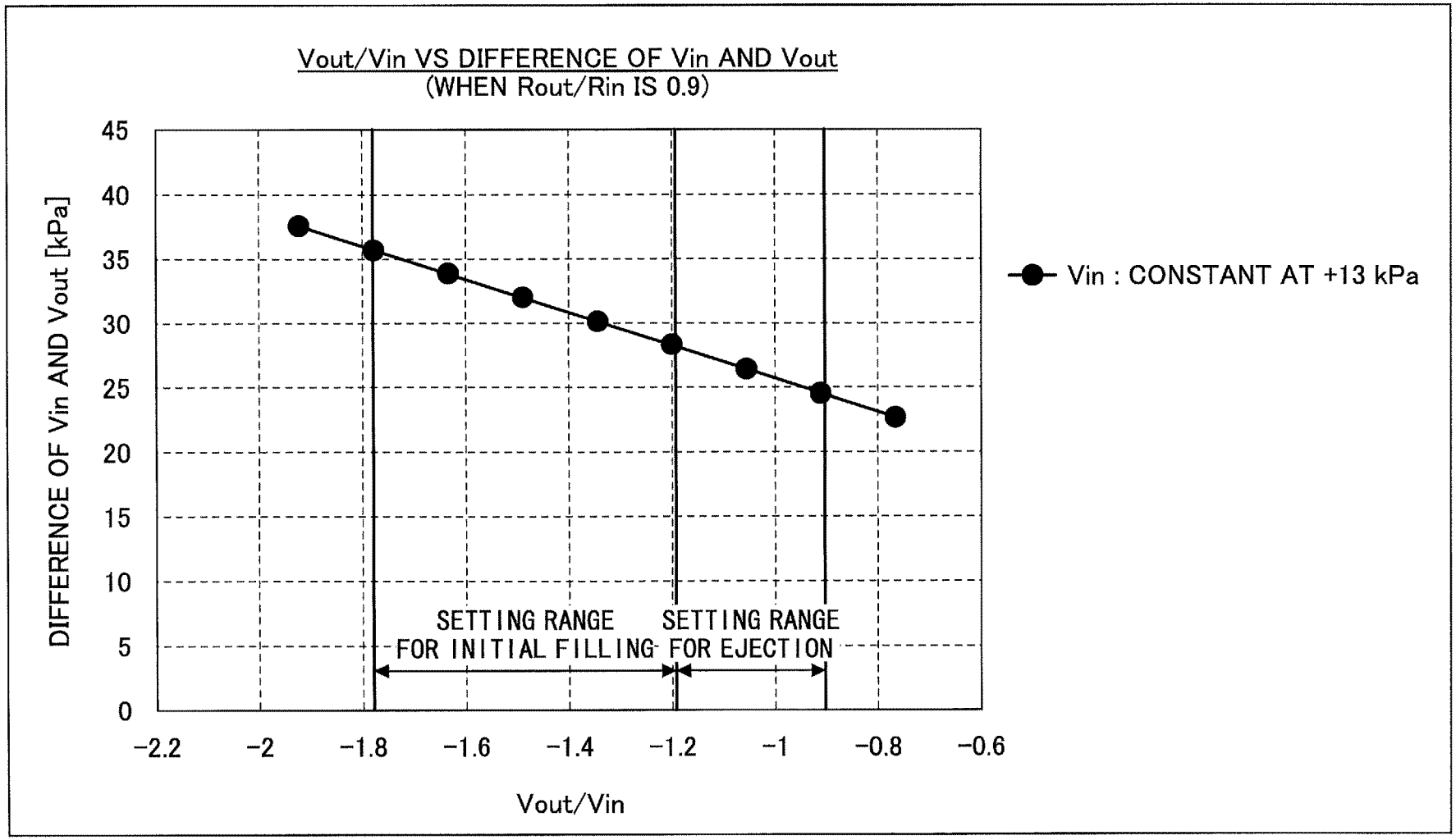
FIG. 13 is a graph also illustrating effects of the liquid circulating apparatus.
Figure 14:
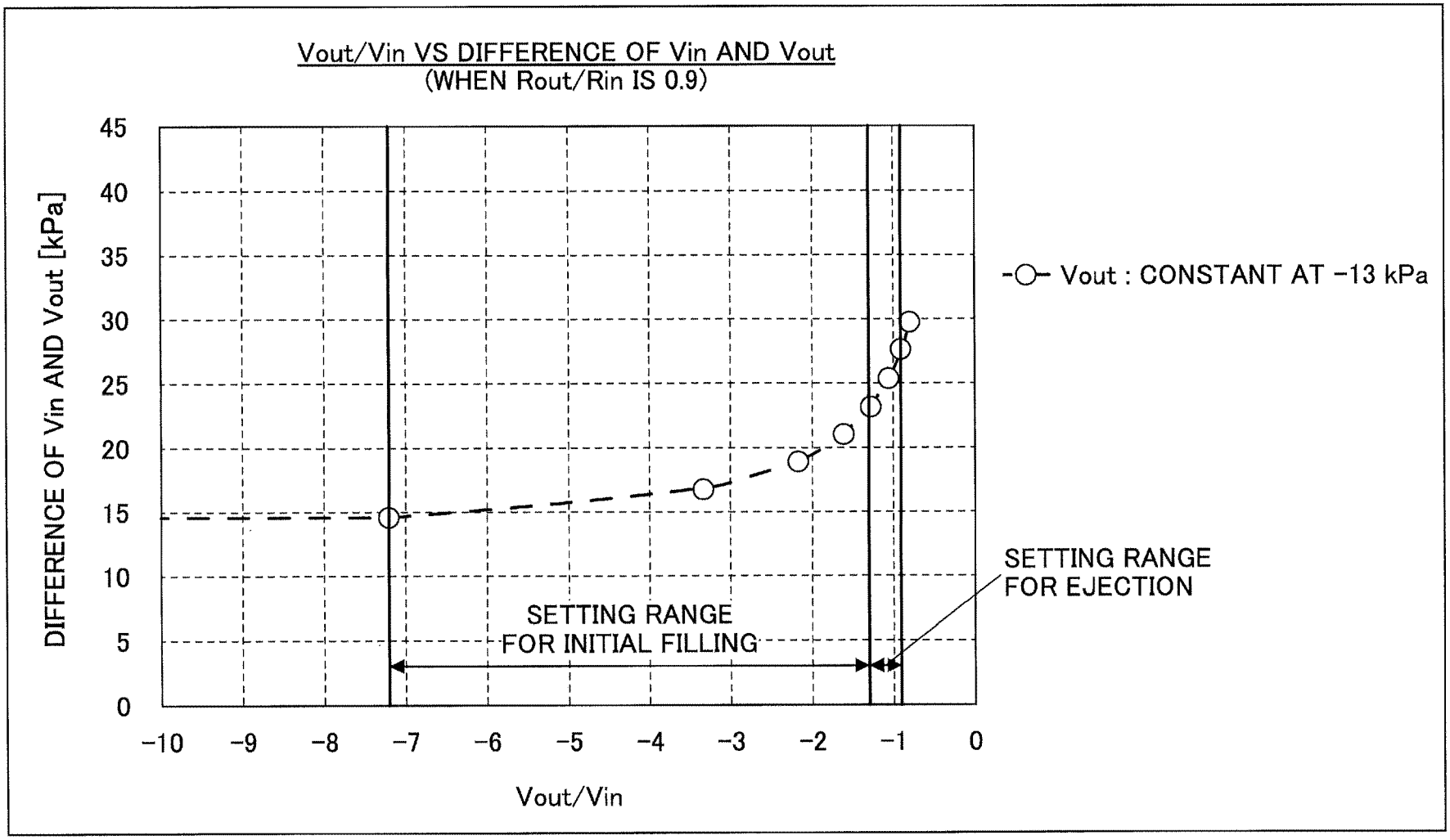
FIG. 14 is a graph also illustrating effects of the liquid circulating apparatus.

Next, FIG. 13 illustrates a relationship between the ratio of the discharge-side pressure Vout to the supply-side pressure Vin (Vout/Vin) and the difference of the supply-side pressure Vin and the discharge-side pressure Vout when the supply-side pressure Vin is constant at +13 kPa. Also, FIG. 14 illustrates a relationship between the ratio of the discharge-side pressure Vout to the supply-side pressure Vin (Vout/Vin) and the difference of the supply-side pressure Vin and the discharge-side pressure Vout. Further, FIG. 15 illustrates a relationship between the difference of the supply-side pressure Vin and the discharge-side pressure Vout versus a flow rate for cases where the supply-side pressure Vin is constant and the discharge-side pressure Vout is constant.

Figure 15:
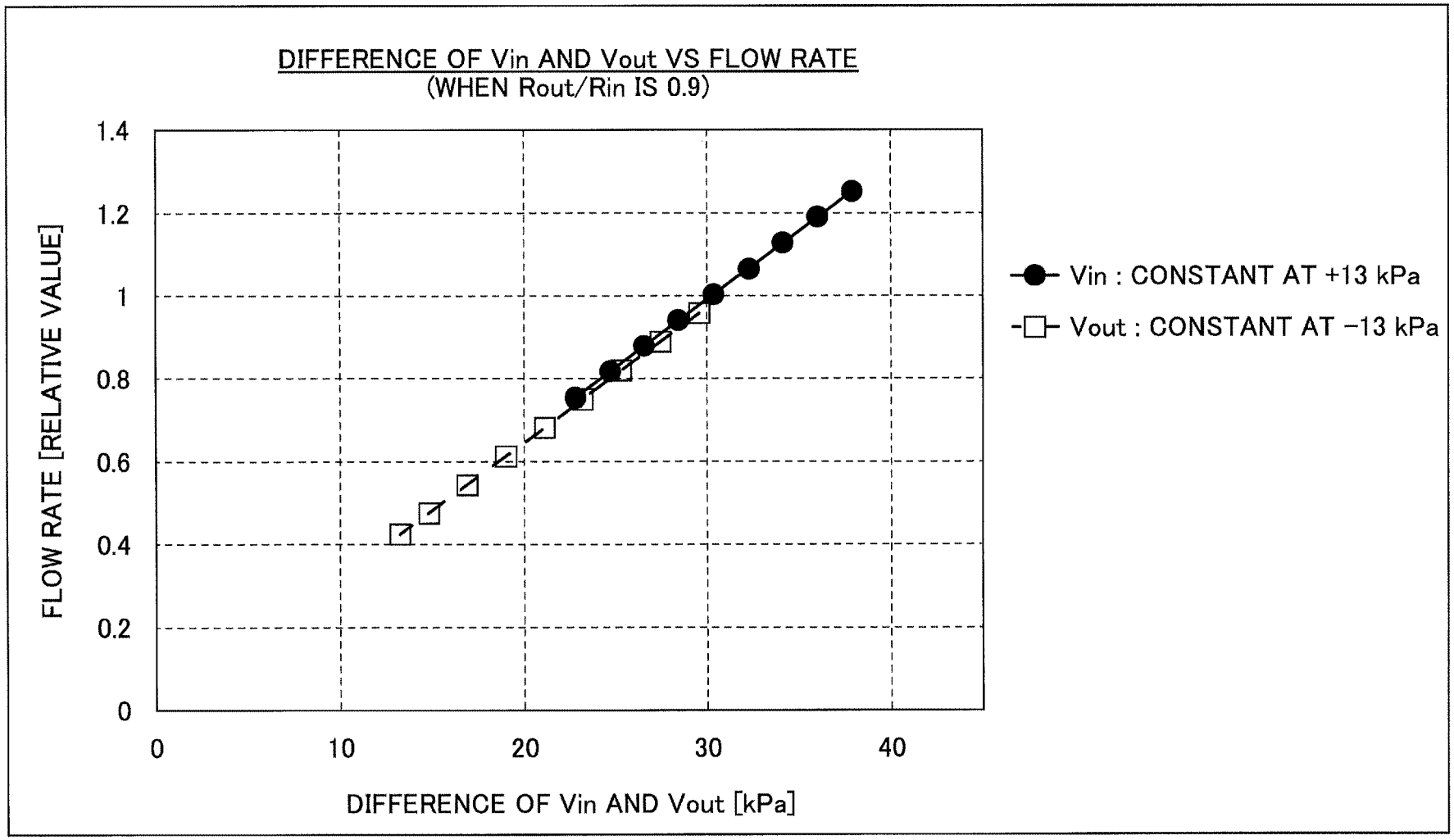
FIG. 15 is a graph also illustrating effects of the liquid circulating apparatus.

As seen from FIG. 15, the relationship between the difference of the supply-side pressure Vin and the discharge-side pressure Vout and the flow rate are the same for both cases where the supply-side pressure Vin is constant and the discharge-side pressure Vout is constant. As seen from FIG. 13 and FIG. 14, the difference between the supply-side pressure Vin and the discharge-side pressure Vout is larger when the supply-side pressure Vin is constant than when the discharge-side pressure Vout is constant. Therefore, the flow rate is larger when the supply-side pressure Vin is constant than when the discharge-side pressure Vout is constant.

Figure 16:
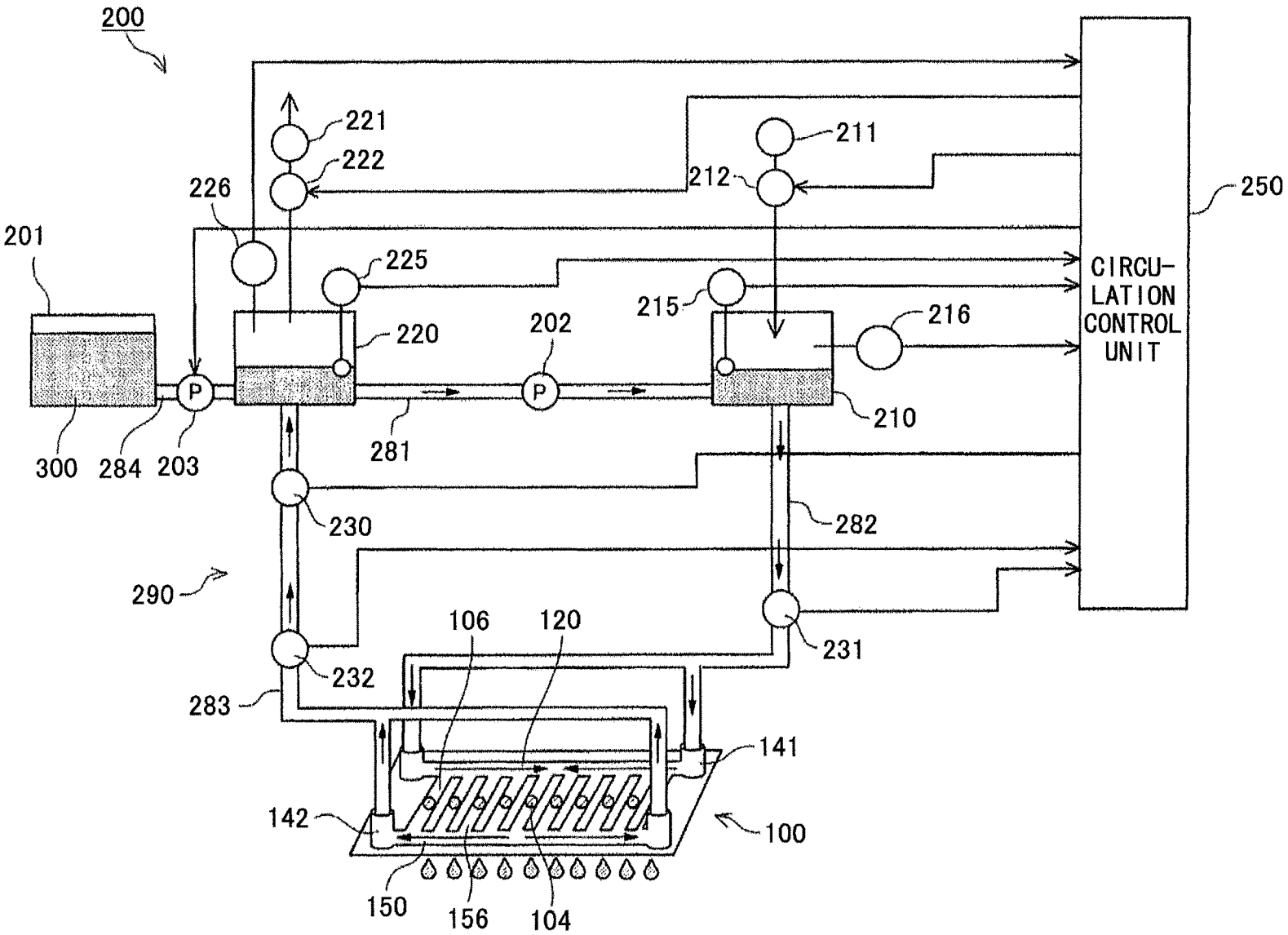
FIG. 16 is a diagram illustrating a liquid circulating apparatus according to a second embodiment of the present invention.

Next, referring to FIG. 16, a second embodiment of the present invention will be described. FIG. 16 is a diagram illustrating a liquid circulating apparatus including a liquid ejecting head according to the second embodiment.

In the second embodiment, a supply-side head pressure sensor 231 is disposed at the supply-side liquid passage 282. The supply-side head pressure sensor 231 detects pressure on liquid supplied from the supply-side tank 210 through the supply-side liquid passage 282 to the head 100 in the same configuration as that of the first embodiment. Also, a discharge-side head pressure sensor 232 is disposed at the discharge-side liquid passage 283. The discharge-side head pressure sensor 232 detects pressure on liquid discharged from the head 100 through the discharge-side liquid passage 283 to the discharge-side tank 220.

Herein, pressure detected by the supply-side head pressure sensor 231 (supply-side head pressure) is represented by Vpin [kPa]. Pressure detected by the discharge-side head pressure sensor 232 (discharge-side head pressure) is represented by Vpout [kPa].

A difference in height between a position where pressure is detected by the supply-side head pressure sensor 231 and a nozzle surface of the head 100 is represented by Hpin [m]. A difference in height between a position where pressure is detected by the discharge-side head pressure sensor 231 and the nozzle surface of the head 100 is represented by Hpout [m]. When the position where pressure is detected is higher than the nozzle surface, it is regarded as positive (+). When the position where pressure is detected is lower than the nozzle surface, it is regarded as negative (−).

Fluid resistance between the supply-side common liquid chamber 120 of the head 100 and the supply-side head pressure sensor 231 is represented by Rpin [Pa·s/m$^3$]. Fluid resistance between the discharge-side common liquid chamber 150 and the discharge-side head pressure sensor 232 is represented by Rpout [Pa·s/m$^3$].

The other parameters are the same as those of the first embodiment.

The meniscus pressure Vm is calculated by the above-described formula (2).

The supply-side pressure Vin is calculated by the following formula (6).

$$Vin = (Vpin + Hpin \times 9.81) - [(Vpin + Hpin \times 9.81) - (Vpout + Hpout \times 9.81)] / (Rpin + Rin + Rout + Rpout) \times Rpin \quad (6)$$

The discharge-side pressure Vout is calculated by the following formula (7).

$$Vout = (Vpout + Hpout \times 9.81) + [(Vpin + Hpin \times 9.81) - (Vpout + Hpout \times 9.81)] / (Rpin + Rin + Rout + Rpout) \times Rpout \quad (7)$$

When liquid is circulated, including when the liquid is ejected from the nozzles 104 based on image data, the supply-side head pressure Vpin and the discharge-side head pressure Vpout are adjusted such that the meniscus pressure Vm in the nozzles becomes within a range of 0 to −2 [kPa].

Also, when initial filling for filling the head 100 with liquid for the first time is performed, the supply-side head pressure Vpin and the discharge-side head pressure Vpout are adjusted such that the meniscus pressure Vm in the nozzles becomes within a range of −2 to −6 [kPa] until at least the inside of the circulation route 290 including the head 100 is filled with the liquid.

Namely, in the first embodiment, in a case where the viscosity of the liquid changes due to a change in the environmental temperature or a change over time in the liquid characteristics, the pressure applied to the liquid in the supply-side common liquid chamber 120 and the discharge-side common liquid chamber 150 of the head 100 changes.

As a result, the pressure Vm on the meniscus formed in the nozzles 104 changes. This may cause the amount of the liquid ejected from the nozzles 104 to change, the liquid to overflow from the nozzles, and the liquid to become unable to be ejected from the nozzles 104.

In light of this, in the second embodiment, when liquid is ejected from the nozzles 104 based on image data, the supply-side head pressure Vpin and the discharge-side head pressure Vpout are adjusted such that the meniscus pressure Vm becomes within the range of 0 to −2 [kPa].

The pressure on the liquid supplied to the head 100 and the liquid discharged from the head 100 are detected at positions close to the supply-side common liquid chamber 120 and the discharge-side common liquid chamber 150 of the head 100. Therefore, changes in both the fluid resistance between the position where the pressure is detected and the supply-side common liquid chamber 120 of the head 100 and the fluid resistance between the position where the pressure is detected and the discharge-side common liquid chamber 150 of the head 100 can be made small.

Accordingly, even when the viscosity of the liquid changes due to a change in the environmental temperature or a change over time in the liquid characteristics, a change in the pressure applied to the liquid in the supply-side common liquid chamber 120 and the discharge-side common liquid chamber 150 of the head 100 becomes small, allowing the pressure on the meniscus formed in the nozzles 104 to be stabilized.

However, because the liquid passages from the supply-side tank 210 through the head 100 to the discharge-side tank 220 are not filled with liquid at the initial filling, the supply-side head pressure Vpin and the discharge-side head pressure Vpout does not reflect pressure on the liquid of the liquid passage 282 and pressure on the liquid of the liquid passage 283.

Therefore, even in a case where the supply-side head pressure Vpin and the discharge-side head pressure Vpout are adjusted, pressure cannot be appropriately applied to the liquid in the head 100. As a result, the pressure on the meniscus in the nozzles 104 becomes too high or too low, causing the liquid to overflow from nozzles 104 or causing bubbles to be suctioned from the nozzles 104. Thus, the liquid passages from supply-side tank 210 through the head 100 to the discharge-side tank 220 cannot be filled with the liquid.

In light of the above, when the initial filling is performed, the supply-side tank pressure Vtin and the discharge-side tank pressure Vtout are adjusted such that the meniscus pressure Vm becomes within the range of −2 to −6 [kPa] after the liquid starts to be supplied from the supply-side tank until at least the liquid passages 282 and 283 are filled with the liquid through the head 100 interposed therebetween.

Accordingly, it becomes possible to appropriately apply pressure to liquid in the head 100 even when the liquid passages from the supply-side tank 210 through the head 100 to the discharge-side tank 220 are not filled with the liquid. Therefore, the liquid passages from the supply-side tank 210 through the head 100 to the discharge-side tank 220 can be filled with the liquid without the liquid overflowing from the nozzles 104.

According to at least one embodiment, liquid can be prevented from dripping at initial filling.

Figure 17:
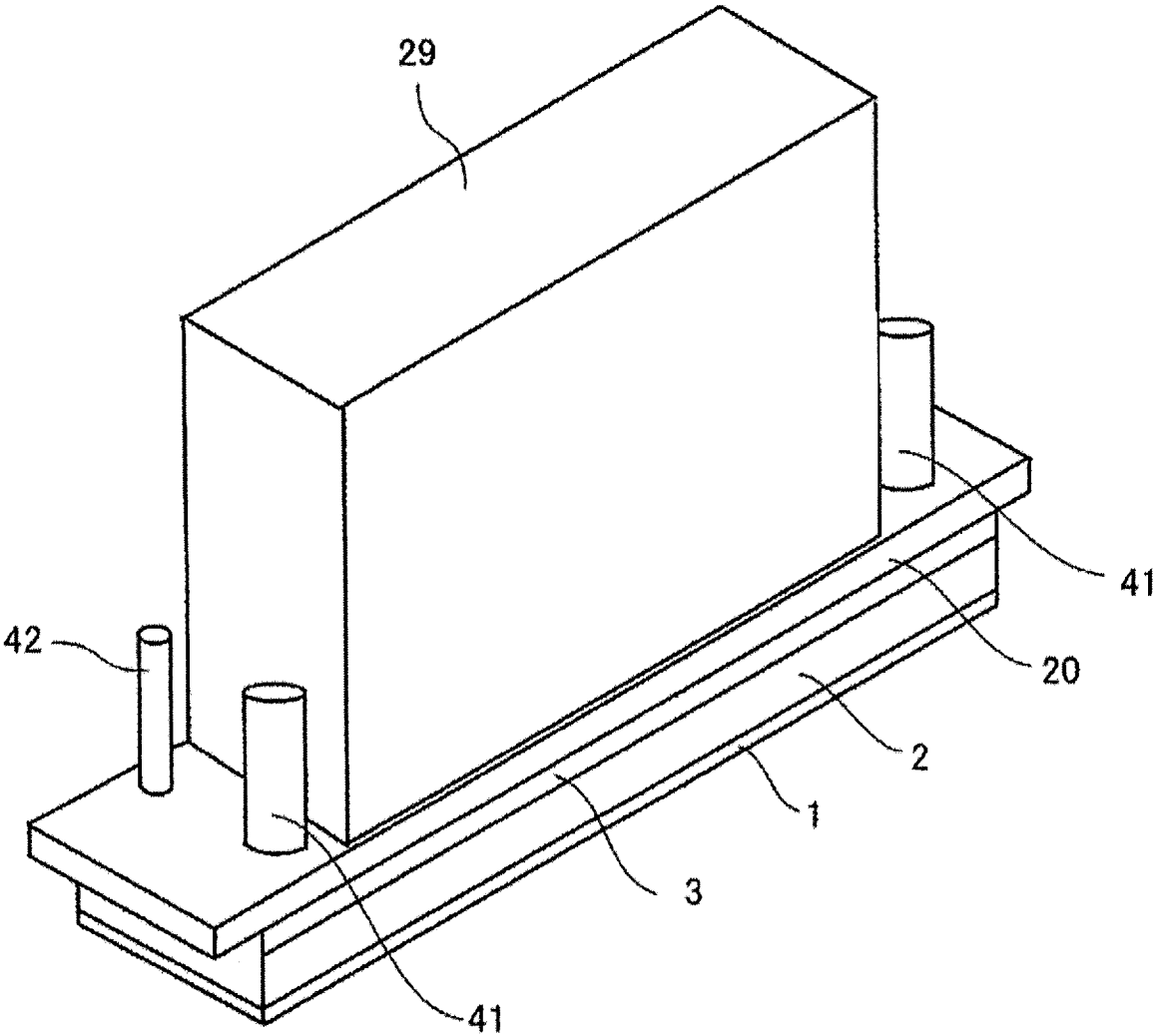
FIG. 17 is an external perspective view illustrating an example of a circulation-type head including individual liquid chambers.
Figure 18:
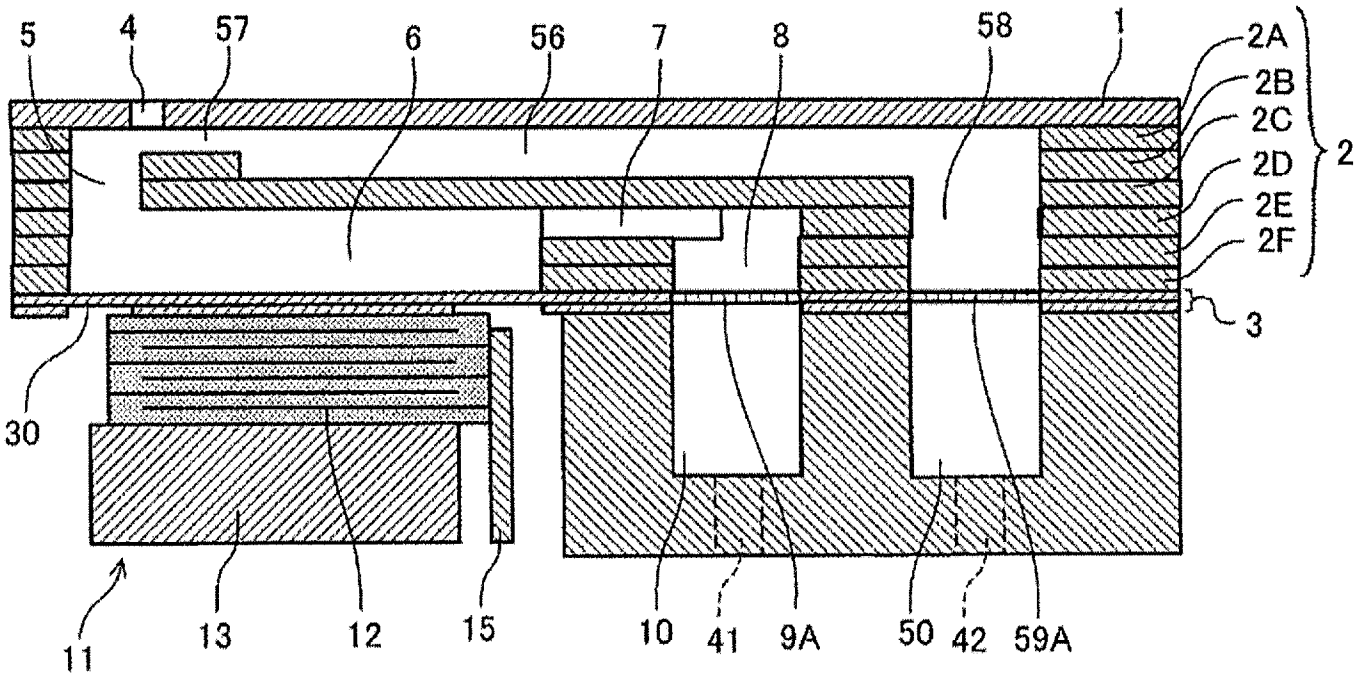
FIG. 18 is a cross-sectional view along a direction perpendicular to a nozzle arrangement direction of the head.

Next, referring to FIG. 17 and FIG. 18, an example of a circulation-type head will be described. FIG. 17 is an external perspective view illustrating the circulation-type head. FIG. 18 is a cross-sectional view along a direction perpendicular to a nozzle arrangement direction of the head.

In the head, a nozzle plate 1, a passage plate 2, and a vibration plate member 3 as a wall surface member are stacked and bonded. The head also includes a piezoelectric actuator 11 that displaces a vibration area (vibration plate) 30 of the vibration plate member 3, a common liquid chamber member 20 serving also as a frame member of the head, and a cover 29.

The nozzle plate 1 includes a plurality of nozzles 4 that eject liquid.

The passage plate 2 forms an individual liquid chamber 6 leading to the nozzles 4 through a nozzle communication passage 5, a supply-side fluid resistance portion 7 communicating with the individual liquid chamber 6, and a supply-side inlet portion 8 leading to the respective supply-side fluid resistance portion 7. The passage plate 2 is formed by stacking plate members 2A through 2F. The supply-side fluid resistance portion 7 and the supply-side inlet portion 8 constitute a supply flow path.

The vibration plate member 3 includes the deformable vibration area 30 that forms a wall of the individual liquid chamber 6 of the passage plate 2. The vibration plate member 3 has a two-layer structure, but is not limited thereto. The vibration plate member 3 includes a first layer including a thin portion facing the passage plate 2 and a second layer including a thick portion. The first layer includes the deformable vibration area 30 at a position corresponding to the individual liquid chamber 6.

At the opposite side of the vibration plate member 3 from the individual liquid chamber 6, the piezoelectric actuator 11 including an electromechanical transducer as a driving unit (an actuator unit or a pressure generating unit) that displaces the vibration area 30 of the vibration plate member 3 is disposed.

The piezoelectric actuators 11 include a required number of beam-shaped piezoelectric elements 12 disposed at predetermined intervals. For example, the beam-shaped piezoelectric elements are formed in a manner such that a piezoelectric member is bonded to a base member 13 and grooves are formed in the piezoelectric member by half-cut dicing. At the vibration area (vibration plate) 30, the piezoelectric elements 12 are bonded to the vibration plate member 3. Further, a flexible wiring member 15 is coupled to the piezoelectric elements 12.

The common liquid chamber member 20 includes a supply-side common liquid chamber 10 and a discharge-side common liquid chamber 50. The supply-side common liquid chamber 10 leads to a supply port 41 as an inlet for supplying liquid from the outside of the head. The discharge-side common liquid chamber 50 leads to a discharge port 42 as an outlet for discharging the liquid to the outside of the head.

The supply-side common liquid chamber 10 leads to the supply-side inlet portion 8 through a filter 9A. The first layer of the vibration plate member 3 forms the filter 9A.

Also, the passage plate 2 includes a discharge-side fluid resistance portion 57 communicating with the respective individual liquid chamber 6 through the nozzle communication passage 5, a discharge-side individual flow path 56, and a discharge-side outlet portion 58.

The discharge-side outlet portion 58 leads to the discharge-side common liquid chamber 50 through a filter 59A. The first layer of the vibration plate member 3 forms the filter 59A.

In the head having the above-described configuration, for example, a voltage applied to the piezoelectric elements 12 is lowered with respect to a reference potential (intermediate potential) such that the piezoelectric elements 12 contract and the vibration area 30 of the vibration plate member 3 is deformed. As a result, the volume of the individual liquid chamber 6 increases, allowing liquid to flow into the individual liquid chamber 6.

Subsequently, the voltage applied to the piezoelectric elements 12 is raised such that the piezoelectric elements 12 expand in the layering direction and the vibration area 30 of the vibration plate member 3 is deformed toward the nozzles 4. As a result, the volume of the individual liquid chamber 6 decreases. Thus, the liquid in the individual liquid chamber 6 is pressurized, allowing the liquid to be ejected from the nozzles 4.

Further, the liquid that is not ejected from the nozzles 4 passes by the nozzles 4 and is discharged through the discharge-side fluid resistance portion 57, the discharge-side individual flow path 56, the discharge-side outlet portion 58, and the filter 59A to the discharge-side common liquid chamber 50. Subsequently, the liquid is re-supplied from the discharge-side common liquid chamber 50 through the circulation route outside the head to the supply-side common liquid chamber 10. Further, even when there is no ejection of liquid, the liquid flows from the supply-side common liquid chamber 10 to the discharge-side common liquid chamber 50, and is re-supplied through the circulation route outside the head to the supply-side common liquid chamber 10.

The method of driving the head is not limited to the above-described example (pull-push ejection method). A pull-ejection method or a push-ejection method may be used in accordance with the way the drive waveform is applied.

Figure 19:
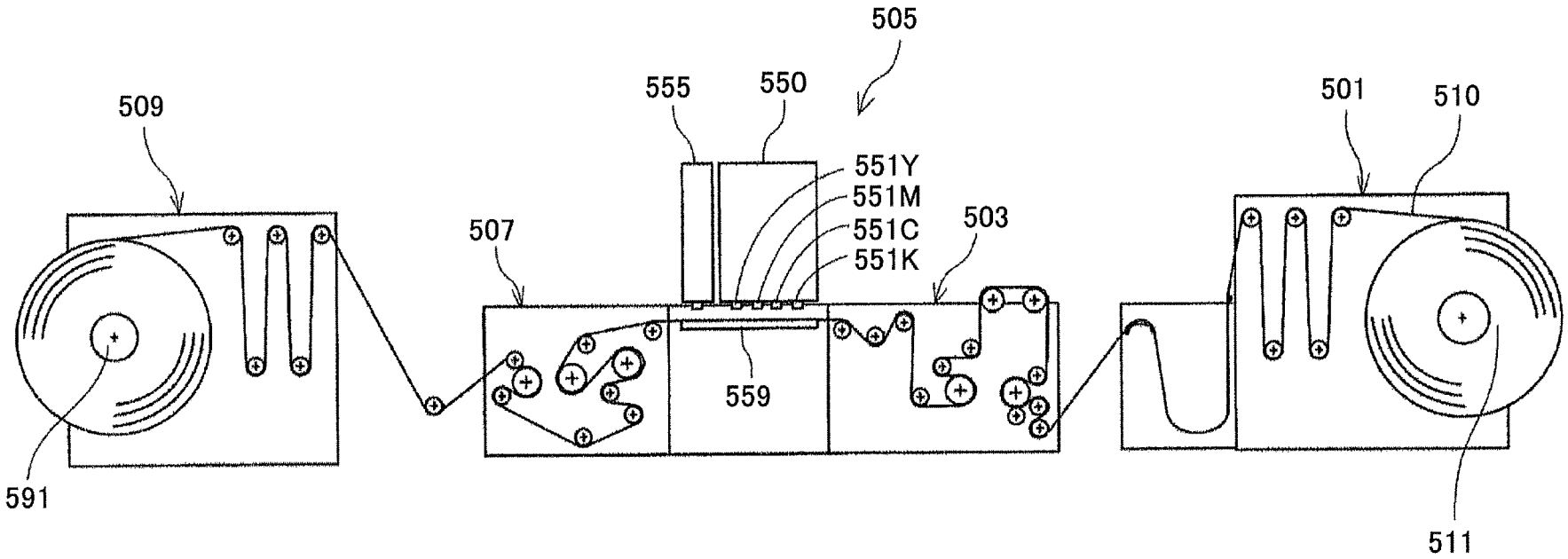
FIG. 19 is a schematic view illustrating an example of a liquid ejecting apparatus according to the embodiment.
Figure 20:
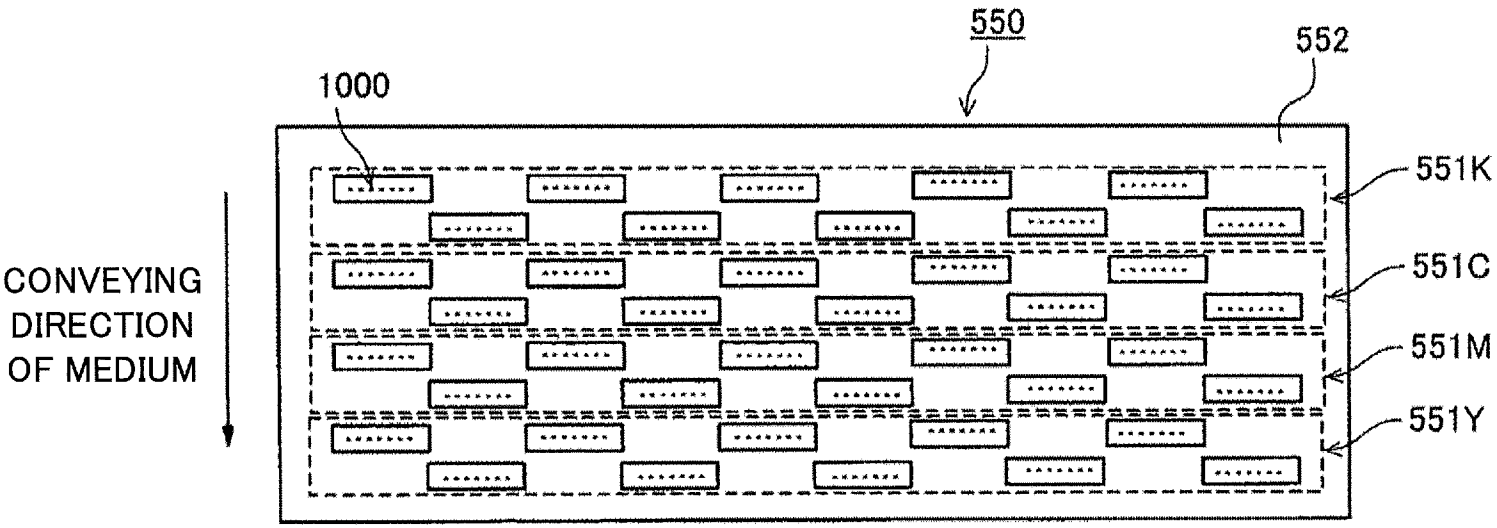
FIG. 20 is a plan view illustrating a head unit of the liquid ejecting apparatus.

Next, referring to FIG. 19 and FIG. 20, an example of a liquid ejecting apparatus will be described. FIG. 19 is a schematic view of the liquid ejecting apparatus. FIG. 20 is a plan view of a head unit of the liquid ejecting apparatus.

The liquid ejecting apparatus includes a conveyor 501 configured to convey a continuous medium 510, a guide conveyor 503 configured to guide and convey the continuous medium 510 to a printing unit 505, the printing unit 505 configured to eject liquid onto the continuous medium 510 such that an image is formed on the continuous medium 510, a dryer unit 507 configured to dry the continuous medium 510, and a discharge unit 509 configured to discharge the continuous medium 510.

The continuous medium 510 is fed from a root winding roller 511 of the conveyor 501, guided and conveyed with rollers of the conveyor 501, the guide conveyor 503, the dryer unit 507, and the discharge unit 509, and wound around a winding roller 591 of the discharge unit 509.

In the printing unit 505, the continuous medium 510 is conveyed on a conveyance guide member 559 while facing a head unit 550 and a head unit 555. The head unit 550 ejects liquid so as to form an image. Post-treatment is performed using the liquid ejected from the head unit 555.

For example, the head unit 550 includes four-color full-line head arrays 551K, 551C, 551M, and 551Y (hereinafter referred to as "head arrays 551" unless colors are distinguished) from an upstream side in a conveying direction of the medium.

The head arrays 551 are liquid ejectors configured to eject liquid of black K, cyan C, magenta M, and yellow Y onto the continuous medium 510, respectively. The types of colors and the number of colors are not limited thereto.

In the head arrays 551, a plurality of circulation-type heads 1000 are arranged in a staggered manner on a base member 552. However, the configuration of the head arrays is not limited thereto.

Next, in a case where the liquid circulating apparatus is applied to the liquid ejecting apparatus, a first manifold is disposed between the supply side of the plurality of the heads 1000 including the head arrays 551 and the supply-side tank 210 such that liquid is supplied from the first manifold to the respective heads 1000. Also, a second manifold is disposed between the discharge side of the heads 1000 and the discharge-side tank 220 such that the liquid is discharged from the heads 1000 to the second manifold.

Herein, liquid ejected from the head is not limited and may be any liquid having a sufficient viscosity and surface tension such that the liquid can be discharged from the head. However, preferably, the liquid has a viscosity of 30 mPa·s or more under normal temperature and normal pressure or by heating or cooling. To be more specific, examples of the liquid include a solution, a suspension, and an emulsion, including a solvent such as water and an organic solvent, a colorant such as a dye and a pigment, a functional material such as a polymerizable compound, a resin, and a surfactant, a biocompatible material such as DNA, amino acid, protein, and calcium, and an edible material such as a natural colorant. Such a solution, a suspension, and an emulsion can be used for inkjet ink, a surface treatment solution, a liquid for forming a component of an electronic element or a light-emitting element or an electronic circuit resist pattern, and a solution for three-dimensional shaping.

Examples of an energy generating source for ejecting liquid include a piezoelectric actuator (a laminated piezoelectric element or a thin-film piezoelectric element), a thermal actuator that employs a thermoelectric conversion element such as a thermal resistor, and an electrostatic actuator including a vibration plate and counter electrodes.

A liquid ejecting unit is an integrated unit in which a liquid ejecting head is integrated with at least one of functional parts and mechanisms, and is an assembly of parts related to liquid ejection. For example, the liquid ejecting unit may be a combination of the liquid ejecting head with at least one of a head tank, a carriage, a supply mechanism, a maintenance and recovery mechanism, and a main scanning movement mechanism.

Herein, the integrated unit may be a unit in which the liquid ejecting head and at least one of the functional parts and the mechanisms are fixed to each other by fastening, bonding, or engaging. The integrated unit may also be a unit in which the liquid ejecting head is movably held by at least one of the functional parts and the mechanisms or a unit in which at least one of the functional parts and the mechanisms is movably held by the liquid ejecting head. The liquid ejecting head and at least one of the functional parts and the mechanisms may be removably attached to each other.

Also, examples of the liquid ejecting unit include an integrated unit in which the liquid ejecting head is integrated with the head tank. Also, examples of the liquid ejecting unit include an integrated unit in which the liquid ejecting head and the head tank are connected to each other through, for example, a tube. In such a case, a unit including a filter can be added between the head tank and the liquid ejecting head of the liquid ejecting unit.

Further, examples of the liquid ejecting unit include an integrated unit in which the liquid ejecting head is integrated with the carriage.

Moreover, examples of the liquid ejecting unit include an integrated unit in which the liquid ejecting head is movably held by a guide member that forms a part of the scanning movement mechanism so as to integrate the liquid ejecting head with the scanning movement mechanism. Also, examples of the liquid ejecting unit include an integrated unit in which the liquid ejecting head is integrated with the carriage and the main scanning movement mechanism.

Further, examples of the liquid ejecting unit include an integrated unit in which the liquid ejecting head is integrated with the carriage and the maintenance and recovery mechanism by fixing a cap member, forming a part of the maintenance and recovery mechanism, to the carriage on which the liquid ejecting head is mounted.

Further, examples of the liquid ejecting unit include an integrated unit in which the liquid ejecting head is integrated with the supply mechanism by coupling a tube to the liquid ejecting head to which the head tank or a flow path component is attached. Through this tube, liquid is supplied from a storage tank to the liquid ejecting head.

The main scanning movement mechanism includes a guide member alone. Also, the supply mechanism includes a tube alone or a loading unit alone.

Examples of the liquid ejecting apparatus include an apparatus that includes the liquid ejecting head or the liquid ejecting unit and is configured to eject liquid by driving the liquid ejecting head. Examples of the liquid ejecting apparatus include not only an apparatus configured to eject liquid onto a material to which the liquid can adhere, but also an apparatus configured to eject liquid toward gas or into liquid.

The liquid ejecting apparatus can include devices configured to feed, convey, and eject a material to which liquid can adhere. The liquid ejecting apparatus can also include a pre-treatment apparatus and a post-treatment apparatus.

For example, the liquid ejecting apparatus may be an imaging forming apparatus configured to eject ink so as to form an image on paper, or may be a three-dimensional shaping apparatus configured to discharge shaping liquid onto a powder layer formed of layers of powder such that a three-dimensional object is shaped.

The liquid ejecting apparatus is not limited to an apparatus configured to eject liquid to visualize images with signification such as characters and figures. For example, the liquid ejecting apparatus includes an apparatus configured to form patterns without signification, three-dimensional images, and the like.

The above-described material to which liquid can adhere" represents a material to which liquid can at least temporarily adhere, a material to which liquid adheres and is fixed, and a material to which liquid adheres and penetrates. To be more specific, examples of the material to which liquid can adhere include a recording medium such as paper, recording paper, a recording paper sheet, a film, and a cloth, an electronic component such as an electronic substrate and a piezoelectric element, and a medium such as a powder layer, an organ model, and a cell for testing. The material to which liquid can adhere includes any material to which liquid adheres, unless particularly limited.

The material to which liquid can adhere may be any material to which liquid can adhere even temporarily such as paper, threads, fibers, fabrics, leather, metal, plastic, glass, wood, and ceramics.

Further, the liquid ejecting apparatus is an apparatus configured to relatively move the liquid ejecting head and the material to which liquid can adhere, but is not limited thereto. To be more specific, examples of the liquid ejecting apparatus include a serial-type apparatus that moves the liquid ejecting head or a line-type apparatus that does not move the liquid ejecting head.

Further, examples of the liquid ejecting apparatus include a treatment liquid coating apparatus configured to eject and apply treatment liquid onto a sheet such that the surface of the sheet is reformed, and an injection granulation apparatus configure to inject, through nozzles, a composition liquid including raw materials dispersed in a solution such that fine particles of the raw materials are granulated.

The terms image formation, recording, character printing, image printing, printing, and shaping are used synonymously with each other.

Further, the present invention is not limited to these embodiments, but various variations and modifications may be made without departing from the scope of the present invention.

What is claimed is:

1. A liquid circulating apparatus comprising, a circulation route configured to circulate liquid through a liquid ejecting head, the circulation route including:

a supply-side tank leading to a supply port of the liquid ejecting head; and a discharge-side tank leading to a discharge port of the liquid ejecting head, wherein the liquid is circulated by setting pressure in the supply-side tank higher than pressure in the discharge-side tank, and a sum of pressure in the supply-side tank and the pressure in the discharge-side tank is set smaller during an entire period of initial filling for completely filling the circulation route and the liquid ejecting head with the liquid than when the liquid is circulated, wherein the pressure in the supply-side tank is set smaller during the entire initial filling than when the liquid is circulated, and wherein the pressure in the discharge-side tank is set to negative pressure during the entire initial filling.

2. The liquid circulating apparatus according to claim 1, wherein the pressure in the supply-side tank is set to positive pressure and the pressure in the discharge-side tank is set to negative pressure when the liquid is circulated.

3. The liquid circulating apparatus according to claim 1, comprising:

a detecting unit configured to detect the pressure in the supply-side tank;

a detecting unit configured to detect the pressure in the discharge-side tank; and a control unit configured to control an operation of the initial filling based on a detection result by the detecting units.

4. The liquid circulating apparatus according to claim 1, wherein the pressure in the discharge-side tank is set smaller during the entire initial filling than when the liquid is circulated.

5. The liquid circulating apparatus according to claim 1, wherein the pressure in the supply-side tank and the pressure in the discharge-side tank are set smaller during the entire initial filling than when the liquid is circulated.

6. The liquid circulating apparatus according to claim 1, wherein a compressor configured to raise the pressure in the supply-side tank is coupled to the supply-side tank, and pressure rise by the compressor is set smaller during the entire initial filling than when the liquid is circulated.

7. The liquid circulating apparatus according to claim 1, wherein a pressure reducing unit configured to reduce the pressure in the discharge-side tank is coupled to the discharge-side tank, and pressure reduction by the pressure reducing unit is set smaller during the entire initial filling than when the liquid is circulated.

8. A liquid ejecting apparatus comprising:

a liquid ejecting head configured to eject liquid; and the liquid circulating apparatus according to claim 1.

9. The liquid ejecting apparatus according to claim 8, wherein the liquid ejecting head includes a supply-side common liquid chamber configured to supply liquid to an supply-side individual liquid chamber communicating with a nozzle that is configured to eject the liquid, and a discharge-side common liquid chamber leading to a discharge-side individual liquid chamber leading to the supply-side individual liquid chamber, pressure in the supply-side common liquid chamber and pressure in the discharge-side common liquid chamber are controlled so as to be constant when the liquid is circulated, and pressure in a supply-side tank and pressure in a discharge-side tank are controlled so as to be constant when initial filling is performed.

10. The liquid ejecting apparatus according to claim 8, wherein meniscus pressure in a nozzle of the liquid ejecting head is within a range of 0 to −2 [kPaG] when the liquid is circulated, and the meniscus pressure in the nozzle is lower than −2 [kPaG] when initial filling is performed.

11. The liquid ejecting apparatus according to claim 8, wherein meniscus pressure in a nozzle is within a range of −2 to −6 [kPaG] when initial filling is performed.

12. The liquid circulating apparatus according to claim 1, further comprising:

a compressor connected to the supply-side tank through a first regulator, and a pressure reducing unit connected to the discharge-side tank through a second regulator, wherein the sum of the pressure in the supply-side tank and the pressure in the discharge-side tank pressure in the supply-side tank is controlled by opening and closing the first regulator and the second regulator while operating the compressor and the pressure reducing unit.

13. The liquid circulating apparatus according to claim 1, wherein the liquid ejecting head comprises a plurality of liquid chambers, each having a supply port, and wherein all of the plurality of liquid chambers are filled with the liquid by completing the entire initial filling.

14. The liquid circulating apparatus according to claim 1, wherein a sum of the negative pressure in the supply-side tank and the negative pressure in the discharge-side tank is set so as for meniscus pressure in a nozzle of the liquid ejecting head to be within a range of 0 to −2 [kPaG] when the liquid is circulated, and lower than −2 [kPaG] in real value when the initial filling is performed.

15. The liquid circulating apparatus according to claim 1, wherein the sum of pressure in the supply-side tank and the pressure in the discharge-side tank during the entire period of initial filling is −2.7 to −10.7 kPa.

16. The liquid circulating apparatus according to claim 1, wherein the liquid circulating apparatus further comprises a vacuum pump configured to generate the negative pressure in the discharge-side tank during the entire initial filling.

* * * * *